US010421286B2

(12) United States Patent
Suzuki

(10) Patent No.: US 10,421,286 B2
(45) Date of Patent: Sep. 24, 2019

(54) LIQUID EJECTING APPARATUS AND LIQUID SUPPLY METHOD FOR LIQUID EJECTING APPARATUS

(71) Applicant: SEIKO EPSON CORPORATION, Tokyo (JP)

(72) Inventor: Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 15/903,776

(22) Filed: Feb. 23, 2018

(65) Prior Publication Data

US 2018/0244067 A1 Aug. 30, 2018

(30) Foreign Application Priority Data

Feb. 24, 2017 (JP) ..... 2017-033598

(51) Int. Cl.
*B41J 2/175* (2006.01)
*B41J 2/165* (2006.01)

(52) U.S. Cl.
CPC ..... *B41J 2/17596* (2013.01); *B41J 2/16526* (2013.01); *B41J 2/16532* (2013.01); *B41J 2002/16594* (2013.01)

(58) Field of Classification Search
CPC . B41J 2/17596; B41J 2/16526; B41J 2/16532
See application file for complete search history.

(56) References Cited

U.S. PATENT DOCUMENTS

2009/0147053 A1 6/2009 Yokouchi
2009/0167795 A1* 7/2009 Yokouchi ..... 347/6

FOREIGN PATENT DOCUMENTS

JP 2005-042649 A 2/2005
JP 2009-160912 A 7/2009
JP 2009-226625 A 10/2009
JP 2012-030496 A 2/2012
JP 2012-166509 A 9/2012
JP 2014-162006 A 9/2014
JP 2015-080862 A 4/2015
JP 2016-197082 A 11/2016

* cited by examiner

*Primary Examiner* — Juanita D Jackson
(74) *Attorney, Agent, or Firm* — Workman Nydegger

(57) ABSTRACT

A liquid ejecting apparatus includes a liquid ejecting unit that ejects liquid, and a plurality of pumps each supplying the liquid toward the liquid ejecting unit by repeating a sucking state and a discharging state. When one of the pumps is in the discharging state and a storage amount of the liquid stored in the pump chamber of the one pump becomes equal to a threshold, another of the pumps is switched to the discharging state. A value obtained by adding an inflow of the liquid flowed into the pump chamber of the other pump to an ejection amount of the liquid ejected from the liquid ejecting unit is defined as a discharge amount of the liquid discharged from the pump chamber of the one pump during a period of the discharging state.

8 Claims, 8 Drawing Sheets

LIQUID EJECTING APPARATUS AND LIQUID SUPPLY METHOD FOR LIQUID EJECTING APPARATUS

BACKGROUND

1. Technical Field

The present invention relates to a liquid ejecting apparatus such as an ink jet printer, for example, and a liquid supply method for the same.

2. Related Art

There are known liquid ejecting apparatuses that print on a medium by ejecting liquid stored in a liquid container from a liquid ejecting head. Some of such liquid ejecting apparatuses include a pump that sucks liquid from a liquid container, and discharges the sucked liquid to a liquid ejecting head.

JP-A-2014-162006 discloses a liquid ejecting apparatus including a plurality of pumps. This liquid ejecting apparatus can continuously supply liquid from a liquid container to a liquid ejecting head by causing the pumps to alternately repeat sucking of liquid and ejection of liquid at different timings.

In the liquid ejecting apparatus of JP-A-2014-162006, the pumps that continuously supply liquid from the liquid container to the liquid ejecting head are frequently driven, and therefore the life of the pumps tends to be short. If the life of the pumps is short, maintenance operations such as replacing pumps need to be performed frequently, which reduces the usability.

SUMMARY

An advantage of some aspects of the invention is that there are provided a liquid ejecting apparatus with improved usability and a liquid supply method for the same.

The following describes solutions to the above problem and the advantages thereof.

A liquid ejecting apparatus according to an aspect of the invention includes: a liquid ejecting unit; a plurality of liquid supply flow paths that have upstream sides connected to a liquid supply source and downstream sides merged and connected to a common flow path extending from the liquid ejecting unit, and that supply the liquid from a liquid supply source side toward the liquid ejecting unit; and a plurality of pumps that are provided in the respective liquid supply flow paths, each of the pumps pressure-feeding the liquid from the liquid supply source side toward the liquid ejecting unit by repeating a sucking state in which the liquid is sucked into a pump chamber thereof and a discharging state in which the liquid is discharged from the pump chamber; wherein the plurality of pumps are configured such that when one of the pumps is in the discharging state and a storage amount of the liquid stored in the pump chamber of the one pump becomes equal to a threshold, a first pump operation of placing another of the pumps in the discharging state is performed; wherein a value obtained by adding an inflow of the liquid flowed into the pump chamber of the other pump to an ejection amount of the liquid ejected from the liquid ejecting unit is defined as a discharge amount of the liquid discharged from the pump chamber of the one pump during a period of the discharging state; and wherein the storage amount of the liquid stored in the pump chamber of the one pump is calculated based on the discharge amount of the liquid.

According to this configuration, since the pumps are operated based on the threshold, it is possible to optimize the operation of the pumps, and hence to reduce the number of times the pumps are driven. This extends the life of the pumps. Accordingly, it is possible to provide better usability than before.

In the liquid ejecting apparatus described above, it is preferable that the first pump operation be performed during an ejection operation of ejecting the liquid from the liquid ejecting unit.

According to this configuration, it is possible to continuously pressure-feed liquid to the liquid ejecting unit during the ejection operation.

In the liquid ejecting apparatus described above, it is preferable that before performing an ejection operation of ejecting the liquid from the liquid ejecting unit, if the storage amount of the liquid stored in the pump chamber of the one pump is equal to or less than the threshold, the first pump operation be performed.

According to this configuration, by supplying liquid to the liquid ejecting unit in advance before performing the ejection operation, it is possible to continuously pressure-feed liquid to the liquid ejecting unit during the ejection operation.

In the liquid ejecting apparatus described above, it is preferable that an inflow of the liquid flowed from the pump chamber of the one pump in the discharging state into the pump chamber of the other pump in the sucking state be calculated by multiplying a predetermined set value by elapsed time during which the one pump is in the discharging state and the other pump is in the sucking state.

This configuration can be preferably adopted as a method of calculating the inflow of liquid flowed from the pump chamber of the one pump in the discharging state into the pump chamber of the other pump in the sucking state.

In the liquid ejecting apparatus described above, it is preferable that each of the pumps include a first one-way valve that is located on the liquid supply source side with respect to the pump chamber, and that allows passage of the liquid from the liquid supply source side toward the pump chamber, a second one-way valve that is located on the liquid ejecting unit side with respect to the pump chamber, and that allows passage of the liquid from a pump chamber side toward the liquid ejecting unit, a displacement unit that forms a part of a wall surface of the pump chamber, and that is displaceable in a direction to change a volume of the pump chamber, a displacement mechanism that displaces the displacement unit in a direction of increasing the volume of the pump chamber, and a biasing member that biases the displacement unit in a direction of reducing the volume of the pump chamber, each of the pumps being configured to increase and reduce the volume of the pump chamber to alternately repeat the sucking state and the discharging state.

This configuration can be preferably adopted as the configuration of a pump that sucks and discharges liquid.

In the liquid ejecting apparatus described above, it is preferable that the displacement mechanism be a decompression pump that displaces the displacement unit in the direction of increasing the volume of the pump chamber by decompressing a space adjacent to the displacement unit; and before performing an ejection operation of ejecting the liquid from the liquid ejecting unit, if elapsed time during which the other pump is in the sucking state is greater than a preset time, a second pump operation of causing the one pump and the other pump to suck the liquid be performed.

According to this configuration, it is possible to increase the accuracy of calculating the volume of the pump chamber of the pump in the discharging state.

In the liquid ejecting apparatus described above, it is preferable that an on-off valve be provided that switches a restricted state in which the liquid is restricted from flowing through the common flow path to a communicating state in which the liquid is allowed to flow when an amount of liquid in a liquid chamber provided in the common flow path decreases.

This configuration can be preferably adopted as the configuration for supplying liquid to the liquid ejecting unit.

A liquid supply method according to another aspect of the invention is for a liquid ejecting apparatus including a plurality of liquid supply flow paths that supply liquid from a liquid supply source side toward a liquid ejecting unit that ejects the liquid, and a plurality of pumps that are provided in the respective liquid supply flow paths, each of the pumps pressure-feeding the liquid from the liquid supply source side toward the liquid ejecting unit by repeating a sucking state in which the liquid is sucked into a pump chamber thereof and a discharging state in which the liquid is discharged from the pump chamber. The liquid supply method includes: calculating a storage amount of the liquid stored in the pump chamber of one of the pumps that is in the discharging state based on a discharge amount of the liquid discharged from the pump chamber during a period of the discharging state, the discharge amount of the liquid being a value obtained by adding an inflow of the liquid flowed into the pump chamber of another of the pumps to an ejection amount of the liquid ejected from the liquid ejecting unit; and when the calculated storage amount of the liquid becomes equal to a threshold, performing a first pump operation of placing the other pump in the discharging state.

According to this configuration, it is possible to achieve the same advantageous effects as those achieved by the liquid ejecting apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

Figure 1:
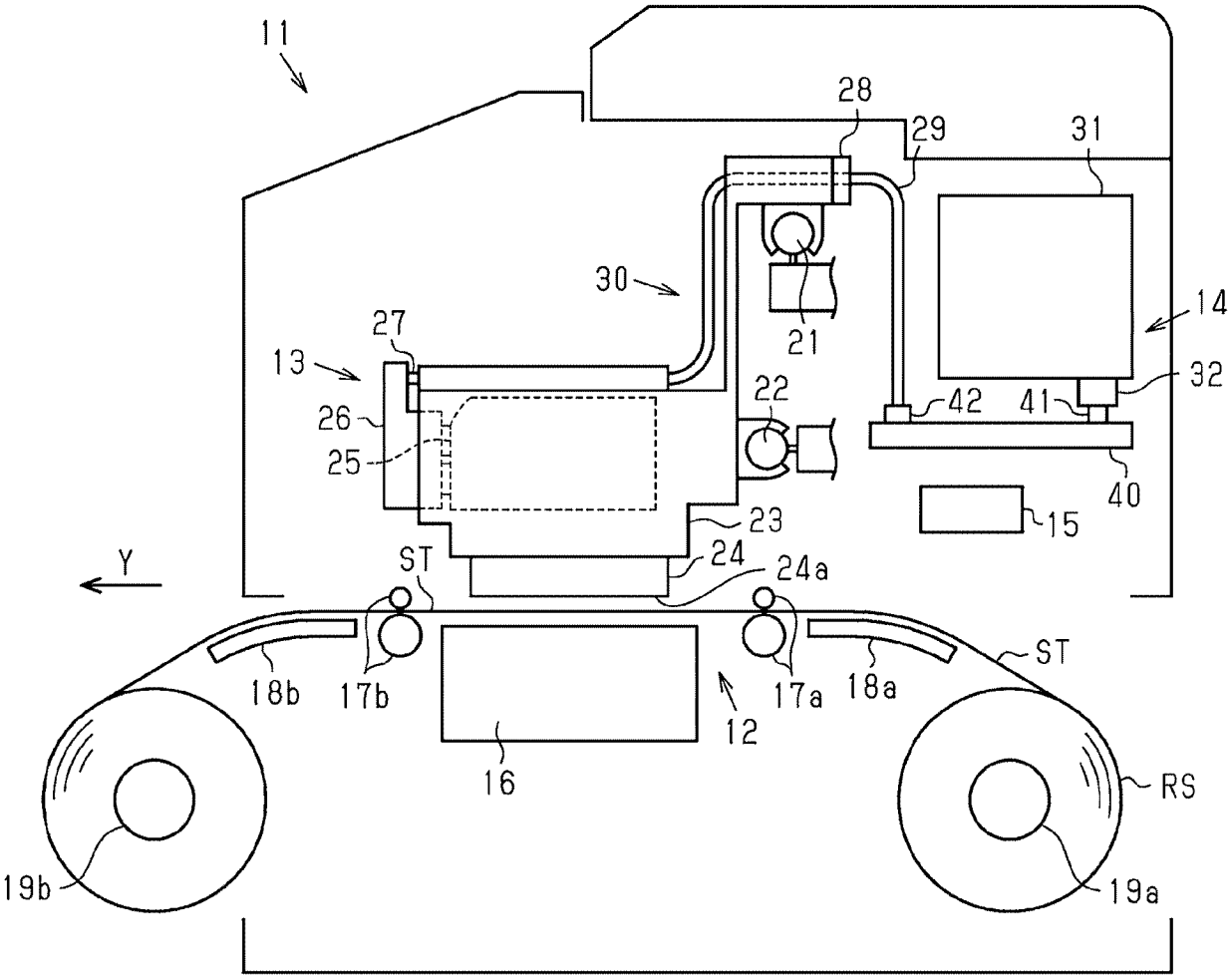
FIG. 1 is a side view schematically illustrating a liquid ejecting apparatus according to an embodiment.

As illustrated in FIG. 1, a liquid ejecting apparatus 11 of this embodiment includes a transport unit 12 that transports a medium ST such as paper in a transport direction Y, and a liquid ejecting unit 13 that ejects liquid such as ink. The liquid ejecting apparatus 11 prints images such as text and pictures on the medium ST, by causing the liquid ejecting unit 13 to eject liquid onto the medium ST that is transported by the transport unit 12. The liquid ejecting apparatus 11 includes a supply unit 14 that supplies liquid to the liquid ejecting unit 13, and a control unit 15 that controls the supply unit 14. The control unit 15 variably controls the amount of liquid supplied to the liquid ejecting unit 13. It is preferable that the control unit 15 perform overall control of the elements of the liquid ejecting apparatus 11.

The transport unit 12 includes a support base 16 that supports the medium ST from the vertically lower side. The support base 16 is disposed under the liquid ejecting unit 13 to extend in a width direction of the medium ST (direction orthogonal to the plane of FIG. 1) in the liquid ejecting apparatus 11. The transport unit 12 includes transport roller pairs 17*a* and 17*b* and guide plates 18*a* and 18*b* disposed upstream and downstream, respectively, of the support base 16 in the transporting direction Y. In the transport direction Y, the guide plate 18*a* is disposed upstream of the transport roller pair 17*a*, while the guide plate 18*b* is disposed downstream of the transport roller pair 17*b*. The transport roller pairs 17*a* and 17*b* rotate while holding the medium ST, and thereby transport the medium ST along the surfaces of the support base 16 and the guide plates 18*a* and 18*b*. In this embodiment, the medium ST is rolled out of roll paper RS that is wound into a roll around a feeding reel 19*a*, and is transported as continuous paper. After being printed by the liquid ejecting unit 13, the medium ST is again wound into a roll around a winding reel 19*b*.

The liquid ejecting apparatus 11 includes guide shafts 21 and 22 extending in a scanning direction corresponding to the width direction of the medium ST that crosses the transport direction Y of the medium ST. The liquid ejecting unit 13 includes a carriage 23 that can be reciprocally moved in the scanning direction by a drive power source (not illustrated) while slidably contacting the guide shafts 21 and 22. The liquid ejecting unit 13 includes a liquid ejecting head 24 that ejects liquid, a storage unit 25 that stores liquid to be supplied to the liquid ejecting head 24, and a connecting tube 27 that supplies liquid to the storage unit 25 via a flow path adapter 26.

The liquid ejecting head 24 includes, on its lower surface, a nozzle forming face 24*a* where a nozzle that ejects liquid is formed. The liquid ejecting head 24 is attached to the lower side of the carriage 23 such that the nozzle forming face 24*a* faces the front surface of the support base 16. The storage unit 25 is attached vertically above the liquid ejecting head 24, in the carriage 23. A supply tube 29 is connected to the connecting tube 27 via a connecting portion 28 provided on the carriage 23. The supply tube 29 is deformable to follow the carriage 23 that reciprocally moves in the scanning direction.

The supply unit 14 includes a liquid supply source 31, and a pressure-feeding unit 40 that pressure-feeds liquid stored in the liquid supply source 31 to the liquid ejecting head 24 through the connecting tube 27 and the supply tube 29. The liquid supply source 31 is provided as an ink cartridge or an ink tank, for example, and a liquid outlet 32 through which liquid flows out is formed on its lower side. The pressure-feeding unit 40 includes a liquid supply needle 41 that can be inserted into the liquid outlet 32 of the liquid supply source 31, and a connecting portion 42 that can be connected to the supply tube 29. When the liquid supply needle 41 is inserted into the liquid outlet 32 of the liquid supply source 31 and the connecting portion 42 is connected to the supply tube 29, the pressure-feeding unit 40 can supply liquid from the liquid supply source 31 to the supply tube 29.

In this embodiment, the storage unit 25, the flow path adapter 26, the connecting tube 27, and the supply tube 29 form a common flow path 30 that extends from the liquid ejecting unit 13. The flow path adapter 26 provided in the common flow path 30 has a function of pressure regulating valve, and is configured to allow passage of liquid when the pressure inside the storage unit 25 decreases to a predetermined pressure or less. That is, the flow path adapter 26 serves as an on-off valve that switches from a restricted state in which liquid is restricted from flowing through the common flow path 30 to a communicating state in which liquid is allowed to flow when the amount of liquid in the storage unit 25 as an example of a liquid chamber provided in the common flow path 30 decreases.

In the following description, in the supply system of liquid from the liquid supply source 31 to the liquid ejecting head 24, the liquid supply source 31 side as the liquid supply source side is referred to as the "upstream side", and the liquid ejecting head 24 side as the liquid ejection side is referred to as the "downstream side".

In the following, the configuration of the pressure-feeding unit 40 will be described with reference to FIGS. 2 and 3. Note that FIG. 3 illustrates cross-sectional views taken along the arrows III-III in FIG. 2.

Figure 2:
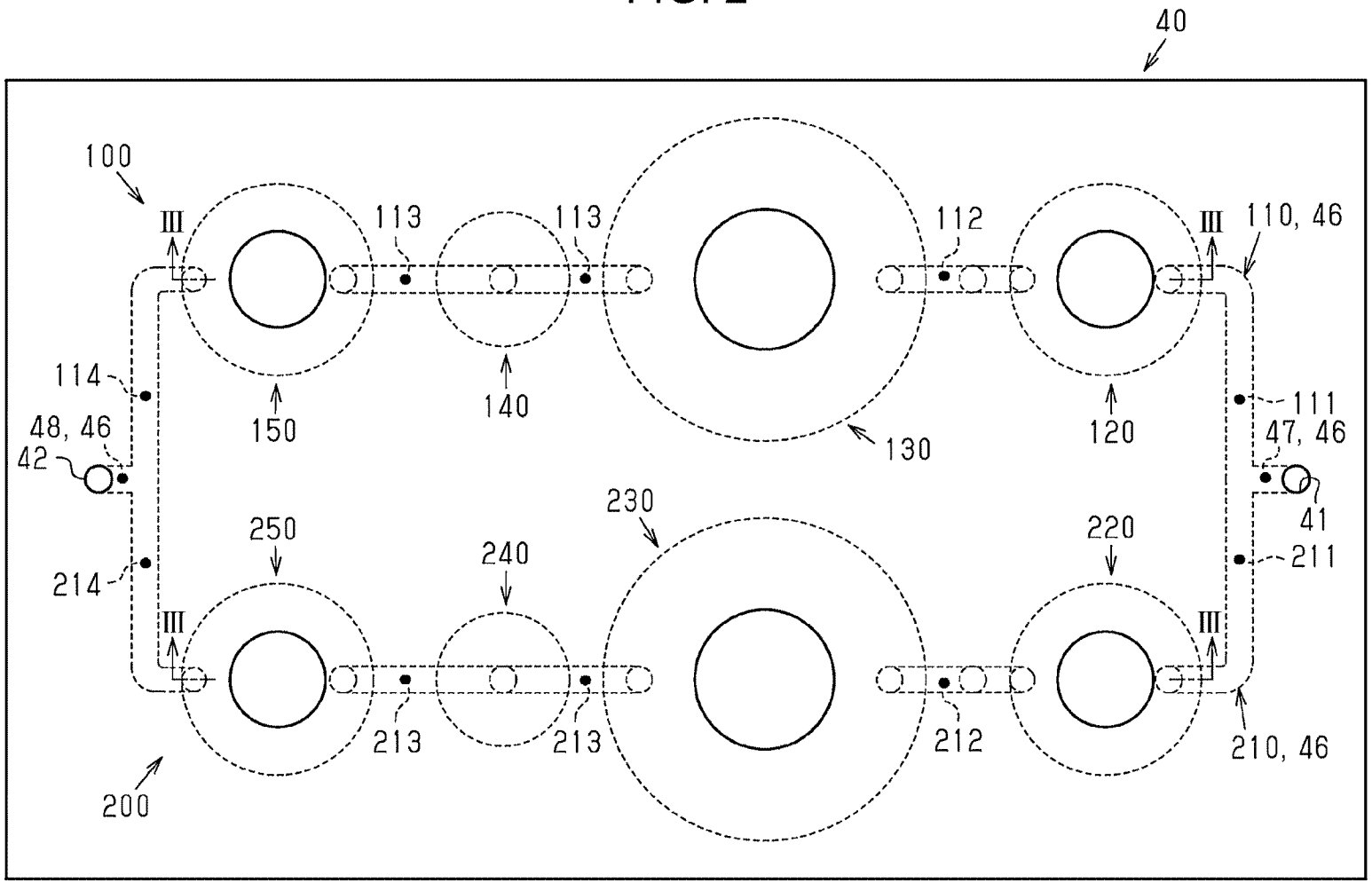
FIG. 2 is a top view of a pressure-feeding unit.
Figure 3:
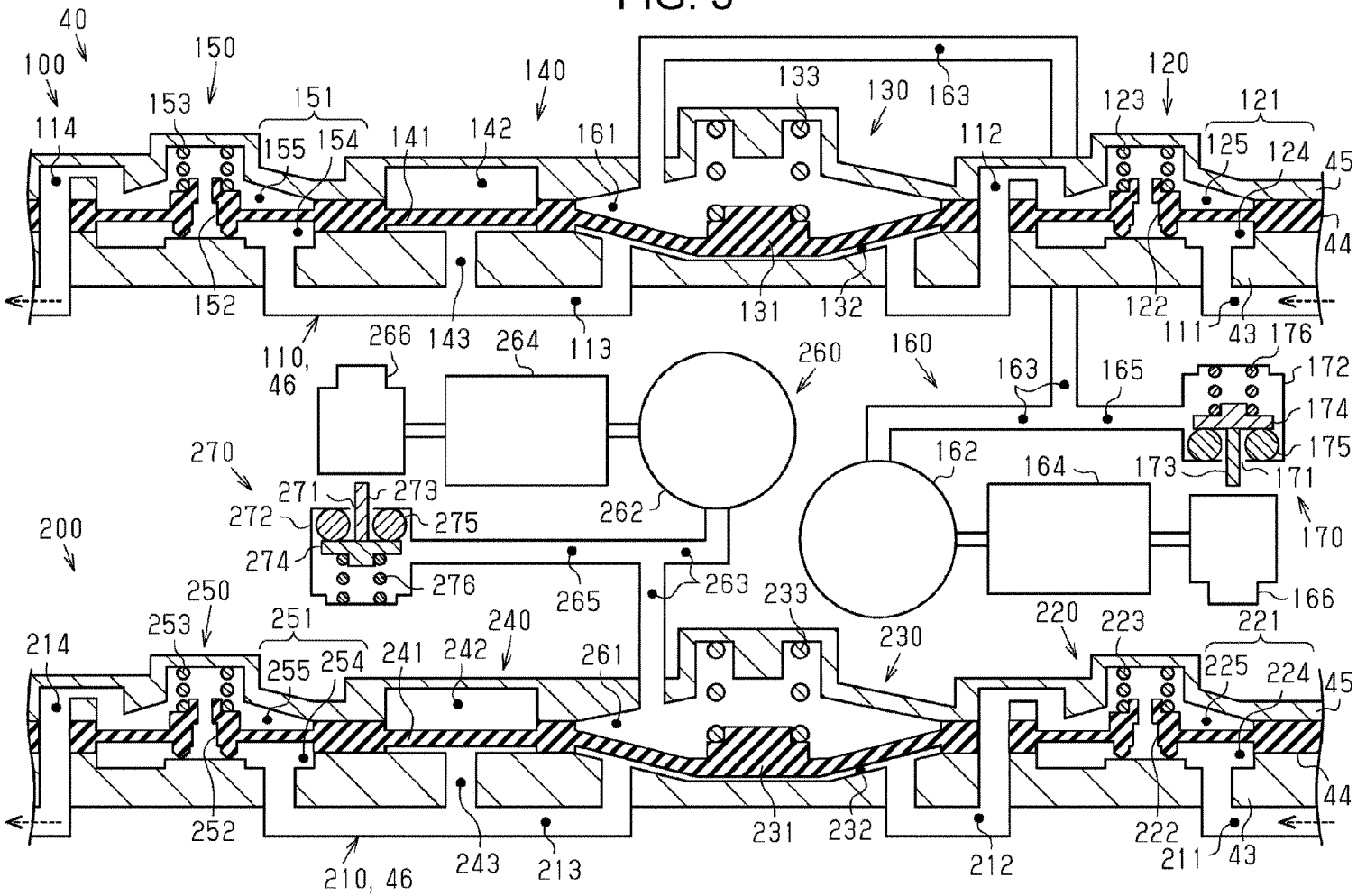
FIG. 3 illustrates cross-sectional views taken along the arrows III-III in FIG. 2.

As illustrated in FIGS. 2 and 3, the pressure-feeding unit 40 includes a first flow path forming member 43 having a substantially rectangular plate shape, an elastic member 44 stacked on the first flow path forming member 43, and a second flow path forming member 45 stacked on the elastic member 44. The flow path forming members 43 and 45 are made of a rigid material such as resin and metal, whereas the elastic member 44 is made of rubber or the like that is resistant to liquid. The pressure-feeding unit 40 includes a communication flow path 46 for communication between the liquid supply source 31 located upstream and the supply tube 29 located downstream, and a first pressure-feeding unit 100 and a second pressure-feeding unit 200 that pressure-feed liquid from the upstream side to the downstream side.

The communication flow path 46 in this embodiment splits into two branches on the downstream side with respect to the liquid supply needle 41, and then the branches meet on the upstream side with respect to the connecting portion 42, in the pressure-feeding unit 40. More specifically, the communication flow path 46 includes a single flow path 47 extending from the liquid supply needle 41 located on the most upstream side to the branch point downstream thereof, and a single flow path 48 extending from the connecting portion 42 located on the most downstream side to the branch point upstream thereof. Further, the communication flow path 46 includes a plurality of (two in this embodiment) liquid supply flow paths 110 and 210 each extending between the upstream single flow path 47 and the downstream single flow path 48. The one liquid supply flow path 110 is formed in the first pressure-feeding unit 100, and the other liquid supply flow path 210 is formed in the second pressure-feeding unit 200. That is, the liquid supply flow paths 110 and 210 supply liquid from the liquid supply source 31 side toward the liquid ejecting unit 13. The liquid supply flow paths 110 and 210 have upstream sides merged into the single flow path 47 and connected to the liquid supply source 31, and have downstream sides merged into the single flow path 48 and connected to the supply tube 29 of the common flow path 30.

First one-way valves 120 and 220 that restrict the flow of liquid to one direction, diaphragm pumps 130 and 230 that intermittently supply liquid to the downstream side, pressure regulating units 140 and 240 that regulate the pressure of liquid to be supplied to the downstream side, and second one-way valves 150 and 250 that restrict the flow of liquid to one direction are disposed in this order from the upstream side on the liquid supply flow paths 110 and 210, respectively. That is, the plurality of diaphragm pumps 130 and 230 are provided in the liquid supply flow paths 110 and 210, respectively. Negative pressure generating units 160 and 260 for driving the diaphragm pumps 130 and 230 are connected to the diaphragm pumps 130 and 230, respectively.

The liquid supply flow paths 110 and 210 include, respectively, first flow paths 111 and 211 for communication from the branch point downstream of the liquid supply needle 41 to the first one-way valves 120 and 220, and second flow paths 112 and 212 for communication from the first one-way valves 120 and 220 to the diaphragm pumps 130 and 230. The liquid supply flow paths 110 and 210 include, respectively, third flow paths 113 and 213 for communication from the diaphragm pumps 130 and 230 to the second one-way valves 150 and 250, and fourth flow paths 114 and 214 for communication from the second one-way valves 150 and 250 to the branch point upstream of the connecting portion 42.

The following describes the first one-way valves 120 and 220.

As illustrated in FIG. 3, the first one-way valves 120 and 220 include, respectively, first valve chambers 121 and 221 formed between the stacked flow path forming members 43 and 45, first valve elements 122 and 222 disposed in the first valve chambers 121 and 221, and first compression springs 123 and 223 that bias the first valve elements 122 and 222 toward the first flow path forming member 43. The first valve chambers 121 and 221 include, respectively, upstream first valve chambers 124 and 224 on the upstream side and downstream first valve chambers 125 and 225 on the downstream side that are separated by the first valve elements 122 and 222.

The first valve elements 122 and 222 are formed as a part of the elastic member 44, and are displaceable in the stacking direction of the flow path forming members 43 and 45 (hereinafter also referred to simply as the "stacking direction") in the first valve chambers 121 and 221, respectively. The first compression springs 123 and 223 are disposed in the downstream first valve chambers 125 and 225, respectively, and compressed in the stacking direction. Accordingly, in the state illustrated in FIG. 3, the first compression springs 123 and 223 place the first valve elements 122 and 222 in contact with the first flow path forming member 43 with the biasing force thereof.

Thus, in FIG. 3, the first one-way valves 120 and 220 are in a "valve closed state" in which liquid is restricted from flowing from the first flow paths 111 and 211 to the second flow paths 112 and 212, respectively. Further, when the downstream first valve chambers 125 and 225 are placed under predetermined negative pressure with respect to the upstream first valve chambers 124 and 224, the first one-way valves 120 and 220 are placed in a "valve open state" to allow liquid to flow from the first flow paths 111 and 211 to the second flow paths 112 and 212, respectively.

The following describes the diaphragm pumps 130 and 230.

The diaphragm pumps 130 and 230 include, respectively, diaphragms 131 and 231 disposed between the flow path forming members 43 and 45, pump chambers 132 and 232 formed between the first flow path forming member 43 and the diaphragms 131 and 231, and compression springs 133 and 233 that bias the diaphragms 131 and 231 toward the first flow path forming member 43. The diaphragms 131 and 231 are formed as a part of the elastic member 44. The diaphragms 131 and 231 form a part of the wall surfaces of the pump chambers 132 and 232, and can change the volumes of the pump chambers 132 and 232, respectively, by being displaced in the stacking direction of the flow path forming members 43 and 45. That is, the diaphragms 131 and 231 serve as displacement units that are displaceable in a direction to change the volumes of the pump chambers 132 and 232 that are the spaces adjacent thereto, respectively.

The compression springs 133 and 233 are disposed and compressed between the second flow path forming member 45 and the diaphragms 131 and 231, respectively. Accordingly, in the state illustrated in FIG. 3, the compression springs 133 and 233 place the diaphragms 131 and 231 in contact with the first flow path forming member 43 with the biasing force thereof. In FIG. 3, the diaphragms 131 and 231 are located in the "bottom dead centers" which are the positions closest to the first flow path forming member 43 in the displacement range of the diaphragms 131 and 231. That is, the compression springs 133 and 233 serve as biasing members that bias the displacement units (diaphragms 131 and 231) in the direction of reducing the volumes of the pump chambers 132 and 232, respectively. Note that the positions closest to the second flow path forming member 45 in the displacement range of the diaphragms 131 and 231 are referred to as "top dead centers".

The diaphragm pumps 130 and 230 reciprocally displace the diaphragms 131 and 231 between the top dead centers and the bottom dead centers, thereby intermittently pressure-feeding liquid from the upstream side to the downstream side of the diaphragm pumps 130 and 230, respectively. The state in which the diaphragm pumps 130 and 230 can suck liquid from the liquid supply source 31 by increasing the volumes of the pump chambers 132 and 232 is referred to as a "sucking state", and the state in which the diaphragm pumps 130 and 230 discharge liquid from the pump chambers 132 and 232 are referred to as a "discharging state". In this respect, in this embodiment, the diaphragm pumps 130 and 230 are examples of pumps that increase and reduce the volumes of the pump chambers 132 and 232, respectively, to alternately repeat the sucking state in which liquid is sucked and the discharging state in which liquid is discharged, and thereby pressure-feed liquid from the liquid supply source 31 side toward the liquid ejecting unit 13. Note that the pumps may include negative pressure generating units 160 and 260, the first one-way valves 120 and 220, and the second one-way valves 150 and 250, other than the diaphragm pumps 130 and 230. The control unit 15 described above variably controls the relative discharge timing of the diaphragm pumps 130 and 230.

The following describes the pressure regulating units 140 and 240.

The pressure regulating units 140 and 240 include, respectively, regulating valves 141 and 241 disposed between the flow path forming members 43 and 45, pressure regulating chambers 142 and 242 defined by the second flow path forming member 45 and the regulating valves 141 and 241, and communication flow paths 143 and 243 for communication between the pressure regulating units 140 and 240 and the third flow paths 113 and 213. The regulating valves 141 and 241 are formed as a part of the elastic member 44, and are displaced in the direction of reducing the volumes of the pressure regulating chambers 142 and 242 when the communication flow paths 143 and 243 are placed in a predetermined positive pressure state, respectively.

When the diaphragm pumps 130 and 230 discharge liquid to the downstream side, the pressure regulating units 140 and 240 reduce the supply pressure of liquid in cases such as when the pressure of the discharged liquid becomes equal to or greater than the pressure corresponding to the biasing force of the compression springs 133 and 233 of the diaphragm pumps 130 and 230, respectively. More specifically, when the supply pressure of liquid is high, the pressure regulating units 140 and 240 displace the regulating valves 141 and 241 in the direction of reducing the volumes of the pressure regulating chambers 142 and 242, respectively, to temporarily store liquid to be supplied to the downstream side, and thereby decompress the liquid. This prevents high-pressure liquid from being supplied to the downstream side. In other words, the pressure regulating units 140 and 240 do not operate when the supply pressure of liquid to the downstream side is appropriate.

The following describes the second one-way valves 150 and 250.

The second one-way valves 150 and 250 include, respectively, second valve chambers 151 and 251 formed between the stacked flow path forming members 43 and 45, second valve elements 152 and 252 disposed in the second valve chambers 151 and 251, and second compression springs 153 and 253 that bias the second valve elements 152 and 252 toward the first flow path forming member 43. The second valve chambers 151 and 251 include, respectively, upstream second valve chambers 154 and 254 on the upstream side and downstream second valve chambers 155 and 255 on the downstream side that are separated by the second valve elements 152 and 252.

The second valve elements 152 and 252 are formed as a part of the elastic member 44, and are displaceable in the stacking direction in the second valve chambers 151 and 251, respectively. The second compression springs 153 and 253 are disposed in the downstream second valve chambers 155 and 255, respectively, and compressed in the stacking direction. Accordingly, in the state illustrated in FIG. 3, the second compression springs 153 and 253 place the second valve elements 152 and 252 in contact with the first flow path forming member 43 with the biasing force thereof.

Thus, in FIG. 3, the second one-way valves 150 and 250 are in a "valve closed state" in which liquid is restricted from flowing from the third flow paths 113 and 213 to the fourth flow paths 114 and 214, respectively. Further, when the upstream second valve chambers 154 and 254 are placed in a predetermined positive pressure state with respect to the downstream second valve chambers 155 and 255, the second one-way valves 150 and 250 are placed in a "valve open state" to allow liquid to flow from the third flow paths 113 and 213 to the fourth flow paths 114 and 214, respectively.

That is, the second one-way valves 150 and 250 are valves that are located on the liquid ejecting unit 13 side with respect to the pump chambers 132 and 232, and allow passage of liquid from the pump chambers 132 and 232 side toward the liquid ejecting unit 13, respectively. Meanwhile, the first one-way valves 120 and 220 are valves that are located on the liquid supply source 31 side with respect to the pump chambers 132 and 232, and allow passage of liquid from the liquid supply source 31 side toward the pump chambers 132 and 232, respectively.

The following describes the negative pressure generating units 160 and 260.

The negative pressure generating units 160 and 260 include, respectively, negative pressure chambers 161 and 261 formed between the second flow path forming member 45 and the diaphragms 131 and 231, and decompression pumps 162 and 262 that decompress the negative pressure chambers 161 and 261 by sucking air from the negative pressure chambers 161 and 261. The negative pressure generating units 160 and 260 include, respectively, negative pressure supply paths 163 and 263 for communication between the negative pressure chambers 161 and 261 and the decompression pumps 162 and 262, and electric motors 164 and 264 that drive the decompression pumps 162 and 262.

Each of the decompression pumps 162 and 262 may include a rotary pump such as a tube pump, for example. The electric motors 164 and 264 can be driven in the normal rotation direction and the reverse rotation direction. When generating a negative pressure in the negative pressure chambers 161 and 261, electric motors 164 and 264 are driven in the normal rotation direction to drive the decompression pumps 162 and 262, respectively. The negative pressure generating units 160 and 260 include, respectively, atmosphere opening valves 170 and 270 that allow or prevent communication between the negative pressure chambers 161 and 261 and the atmosphere, atmosphere opening paths 165 and 265 connecting between the atmosphere opening valves 170 and 270 and the negative pressure supply paths 163 and 263, and cam mechanisms 166 and 266 capable of switching the atmosphere opening valves 170 and 270 between the communicating state and the non-communicating state.

The atmosphere opening valves 170 and 270 include, respectively, casings 172 and 272 with atmosphere opening holes 171 and 271, and valve elements 174 and 274 having rods 173 and 273 protruding from the casings 172 and 272 through the atmosphere opening holes 171 and 271. The atmosphere opening valves 170 and 270 include, respectively, seal members 175 and 275 that are held between the atmosphere opening holes 171 and 271 and the valve elements 174 and 274 by the casings 172 and 272, and compression springs 176 and 276 that bias the valve elements 174 and 274 in a direction to compress the seal members 175 and 275. The valve elements 174 and 274 are displaceable in the casings 172 and 272 in the directions in which the rods 173 and 273 extend, respectively. The compression springs 176 and 276 are disposed in the casings 172 and 272, and compressed in the directions in which the rods 173 and 273 extend, respectively. Accordingly, in the state illustrated in FIG. 3, the valve elements 174 and 274 biased by the compression springs 176 and 276 compress the seal members 175 and 275 against the casings 172 and 272, respectively. The cam mechanisms 166 and 266 are rotatably supported by the rotary shafts of the electric motors 164 and 264 via one-way clutches (not illustrated), and are able to press the rods 173 and 273 of the valve elements 174 and 274 when the electric motors 164 and 264 are driven in the reverse rotation direction, respectively.

In FIG. 3, the atmosphere opening valves 170 and 270 are in a "closed state" in which the atmosphere opening holes 171 and 271 are closed by the valve elements 174 and 274 and the seal members 175 and 275, respectively. When the electric motors 164 and 264 are driven in the reverse rotation direction such that the cam mechanisms 166 and 266 press the rods 173 and 273, clearances are formed between the valve elements 174 and 274 and the seal members 175 and 275, respectively. Thus, the atmosphere opening valves 170 and 270 are switched from the closed state to an "open state" to allow communication between the atmosphere opening paths 165 and 265 and the atmosphere, respectively.

The following describes the operation of the pressure-feeding unit 40 performed when supplying liquid from the liquid supply source 31 toward the liquid ejecting unit 13. It is assumed here that the diaphragm pumps 130 and 230 supply liquid to the downstream side at an appropriate pressure, and the effects of the pressure regulating units 140 and 240 are not considered. Note that since the first pressure-feeding unit 100 and the second pressure-feeding unit 200 have similar configurations and perform similar operations, only the operation of the first pressure-feeding unit 100 will be described below.

As illustrated in FIG. 3, in the initial state, the pressure of the decompression pump 162 is set to the atmospheric pressure; the diaphragm 131 is located in the bottom dead center; and the first one-way valve 120 and the second one-way valve 150 are in the valve closed state. Further, liquid is not sucked into the pump chamber 132 of the diaphragm pump 130, and the liquid supply flow path 110 is filled with liquid.

In the state illustrated in FIG. 3, when supplying liquid from the liquid supply source 31 to the liquid ejecting unit 13, the electric motor 164 of the first pressure-feeding unit 100 is first driven in the normal rotation direction. Then, the decompression pump 162 of the first pressure-feeding unit 100 sucks air from the negative pressure chamber 161 that is connected thereto via the negative pressure supply path 163, and thereby places the negative pressure chamber 161 under negative pressure. That is, the negative pressure chamber 161 of the first pressure-feeding unit 100 is more decompressed than the pump chamber 132 that is separated by the diaphragm 131, so that a pressure difference is generated between the negative pressure chamber 161 and the pump chamber 132.

Figure 4:
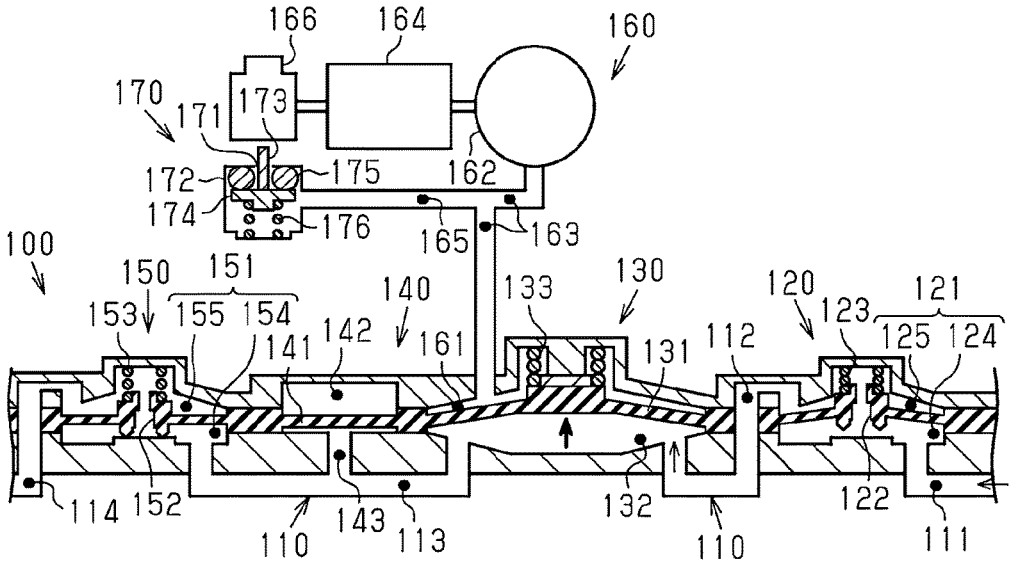
FIG. 4 is a cross-sectional view of a diaphragm pump in a sucking state.

As illustrated in FIG. 4, when the decompression pump 162 of the first pressure-feeding unit 100 continues to be driven and the force corresponding to the pressure difference becomes greater than the biasing force of the compression spring 133, the diaphragm 131 is displaced from the bottom dead center to the top dead center against the biasing force of the compression spring 133. When the diaphragm 131 is displaced toward the top dead center, the pump chamber 132 is placed under negative pressure, and the volume thereof is increased. That is, the decompression pumps 162 and 262 serve as displacement mechanisms that displace the displacement units (diaphragms 131 and 231) in the direction of increasing the volumes of the pump chambers 132 and 232, respectively.

When the pump chamber 132 is placed under negative pressure, the downstream first valve chamber 125 of the first one-way valve 120 communicating with the pump chamber 132 of the first pressure-feeding unit 100 via the second flow path 112 is placed under negative pressure as well as the pump chamber 132. Then, in the first one-way valve 120 of the first pressure-feeding unit 100, when the force corresponding to the pressure difference generated between the upstream first valve chamber 124 and the downstream first valve chamber 125 becomes greater than the biasing force of the first compression spring 123, the first valve element 122 is displaced in a direction to compress the first compression spring 123. As a result, as illustrated in FIG. 4, the first one-way valve 120 of the first pressure-feeding unit 100 is placed in the valve open state, so that the pump chamber 132 of the diaphragm pump 130 communicates with the liquid supply source 31 via the liquid supply needle 41, the single flow path 47, the first flow path 111, the first one-way valve 120, and the second flow path 112. Then, as the diaphragm 131 of the diaphragm pump 130 of the first pressure-feeding unit 100 is displaced, liquid is sucked into the pump chamber 132 from the liquid supply source 31.

Note that, similar to the downstream first valve chamber 125 of the first one-way valve 120, when the decompression pump 162 of the first pressure-feeding unit 100 is driven, the communication flow path 143 of the pressure regulating unit 140 and the upstream second valve chamber 154 of the second one-way valve 150 are placed under negative pressure. The pressure regulating unit 140 and the second one-way valve 150 are configured to operate when the communication flow path 143 and the upstream second valve chamber 154 are placed under positive pressure, respectively. Accordingly, in the first pressure-feeding unit 100, the regulating valve 141 of the pressure regulating unit 140 is not displaced, and the second one-way valve 150 is maintained in the valve closed state.

Subsequently, upon completion of sucking of liquid into the pump chamber 132 of the diaphragm pump 130 of the first pressure-feeding unit 100, the electric motor 164 having been driven in the normal rotation direction is driven in the reverse rotation direction.

Figure 5:
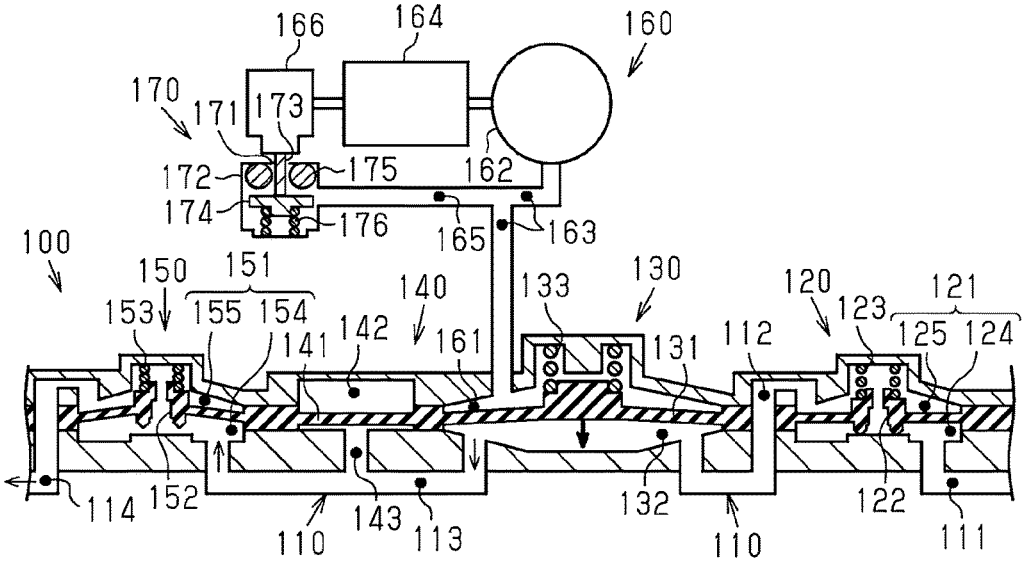
FIG. 5 is a cross-sectional view of the diaphragm pump in a discharging state.

As illustrated in FIG. 5, when the electric motor 164 is driven in the reverse rotation direction, the cam mechanism 166 presses the rod 173, so that the valve element 174 is displaced in a direction to compress the compression spring 176. Thus, a clearance is formed between the valve element 174 and the seal member 175, so that the atmosphere opening valve 170 is placed in the open state to allow the atmosphere opening path 165 to communicate with the atmosphere. Then, as the atmosphere opening valve 170 is placed in the open state, the negative pressure chamber 161 under negative pressure communicates with the atmosphere via the negative pressure supply path 163, the atmosphere opening path 165, and the atmosphere opening valve 170 so as to be open to the atmosphere.

When the negative pressure chamber 161 of the first pressure-feeding unit 100 is open to the atmosphere, air flows into the negative pressure chamber 161 to increase the pressure, so that the pressure difference between the negative pressure chamber 161 and the pump chamber 132 is eliminated. Then, the force corresponding to the pressure difference becomes smaller than the biasing force of the compression spring 133, so that the diaphragm 131 is displaced from the top dead center to the bottom dead center. That is, the diaphragm pump 130 discharges, from the pump chamber 132, an amount of liquid corresponding to the displacement amount of the diaphragm 131 from the top dead center. In this step, while the volume of the negative pressure chamber 161 of the first pressure-feeding unit 100 increases, the volume of the pump chamber 132 of the diaphragm pump 130 decreases, so that the pump chamber 132 under negative pressure is placed under positive pressure.

When the pump chamber 132 of the first pressure-feeding unit 100 is placed under positive pressure, the pressure difference generated between the upstream first valve chamber 124 and the downstream first valve chamber 125 is eliminated in the first one-way valve 120 located upstream of the pump chamber 132. Then, the force corresponding to the pressure difference becomes smaller than the biasing force of the first compression spring 123, so that the first valve element 122 is displaced in a direction to allow the first compression spring 123 to expand. Thus, the first one-way valve 120 of the first pressure-feeding unit 100 is switched from the valve open state to the valve closed state, which prevents communication between the pump chamber 132 of the diaphragm pump 130 and the liquid supply source 31. Accordingly, the first one-way valve 120 in the valve closed state prevents the liquid sucked in the pump chamber 132 of the diaphragm pump 130 from being discharged toward the liquid supply source 31.

Meanwhile, when the pump chamber 132 of the first pressure-feeding unit 100 is placed under positive pressure, the pressure of the upstream second valve chamber 154 increases, so that the pressure difference between the upstream second valve chamber 154 and the downstream second valve chamber 155 gradually increases in the second one-way valve 150 located downstream of the pump chamber 132. Then, when the force corresponding to the pressure difference becomes greater than the biasing force of the second compression spring 153, the second valve element 152 is displaced in a direction to compress the second compression spring 153. As a result, the second one-way valve 150 is placed in the valve open state, so that the pump chamber 132 of the diaphragm pump 130 communicates with the supply tube 29 via the third flow path 113, the second one-way valve 150, the fourth flow path 114, and the single flow path 48.

When the diaphragm 131 of the diaphragm pump 130 is displaced to the bottom dead center, liquid is discharged from the pump chamber 132 toward the liquid ejecting unit 13 located further downstream of the supply tube 29. Note that since the supply pressure of the liquid discharged in this step is not as high as the pressure at which the pressure regulating unit 140 operates, the regulating valve 141 of the pressure regulating unit 140 is not displaced in the direction of reducing the volume of the pressure regulating chamber 142.

In this embodiment, the state in which the negative pressure chambers 161 and 261 are open to the atmosphere and liquid can be discharged toward the liquid ejecting unit 13 corresponds to the discharging state of the diaphragm pumps 130 and 230. Further, the state in which the negative pressure chambers 161 and 261 are placed under negative pressure and not open to the atmosphere corresponds to the sucking state of the diaphragm pumps 130 and 230. Note that the diaphragm pumps 130 and 230 of this embodiment do not discharge all the liquid from the pump chambers 132 and 232 even when the diaphragms 131 and 231 reach the bottom dead centers. Actually, since the second one-way valves 150 and 250 are placed in the valve closed state before all the liquid is discharged from the pump chambers 132 and 232, a small amount of liquid remains in the pump chambers 132 and 232, respectively. That is, when the amount of liquid remaining in the pump chambers 132 and 232 is very small, even if the atmosphere opening valves 170 and 270 are in the open state, the diaphragm pumps 130 and 230 of this embodiment may be unable to discharge liquid toward the liquid ejecting unit 13.

By repeating the operations described above, the diaphragm pump 130 of the first pressure-feeding unit 100 and the diaphragm pump 230 of the second pressure-feeding unit 200 suck liquid from the liquid supply source 31 side, and discharge the sucked liquid toward the liquid ejecting unit 13. When performing an ejection operation of ejecting liquid from the liquid ejecting unit 13, the control unit 15 continuously supplies liquid by switching the diaphragm pumps 130 and 230, which intermittently supply liquid, between the discharging state and the sucking state at relatively different timings. Note that the ejection operation of ejecting liquid indicates not only an operation of ejecting liquid onto the medium ST, but also general operations of ejecting liquid from the liquid ejecting head 24, such as a flashing operation of ejecting liquid to clean the liquid ejecting head 24, and an operation of sucking liquid from the nozzle via a cap and ejecting the liquid.

The following describes the states of the diaphragm pumps 130 and 230 when the liquid ejecting apparatus 11 is in the resting state in which the liquid ejecting apparatus 11 suspends ejection of liquid.

When an ejection operation of ejecting liquid from the liquid ejecting unit 13 completes, the liquid ejecting apparatus 11 is switched from the ejecting state in which liquid is ejected outside to the resting state in which ejection of liquid is suspended. When the liquid ejecting apparatus 11 is placed in the resting state, the liquid ejecting apparatus 11 stops driving the electric motors 164 and 264. When the driving of the electric motors 164 and 264 is stopped, the diaphragm pumps 130 and 230 are maintained in the same states as those at the time of completion of the ejection operation. That is, if the diaphragm pumps 130 and 230 are in the discharging state at the time of completion of the ejection operation, the atmosphere opening valves 170 and 270 are maintained in the open state, so that the negative pressure chambers 161 and 261 are kept open to the atmosphere, respectively. Thus, the diaphragm pumps 130 and 230 are maintained in the discharging state. If the diaphragm pumps 130 and 230 are in the sucking state at the time of completion of the ejection operation, the atmosphere opening valves 170 and 270 are maintained in the closed state, so that the negative pressure chambers 161 and 261 are maintained under negative pressure, respectively. Thus, the diaphragm pumps 130 and 230 are maintained in the sucking state.

In some cases, backflow of liquid occurs at the first one-way valves 120 and 220 and the second one-way valves 150 and 250 that allow passage of liquid in one direction. In fact, it is not realistic that a valve provides the ideal performance to completely limit the flow of liquid to one direction only. That is, there is quite a high risk of backflow of liquid due to the performance of the product, degradation over time, or the like, even though the amount of backflow might be small.

Therefore, in the liquid ejecting apparatus 11 of this embodiment as well, when the driving of the electric motors 164 and 264 is stopped and the diaphragm pumps 130 and 230 are maintained in the sucking state, liquid may flow back from the downstream side of the diaphragm pumps 130 and 230 to the pump chambers 132 and 232, and flow into the pump chambers 132 and 232. Accordingly, the following discusses the second one-way valves 150 and 250 that allow passage of liquid from the pump chambers 132 and 232 to the downstream side.

Figure 6:
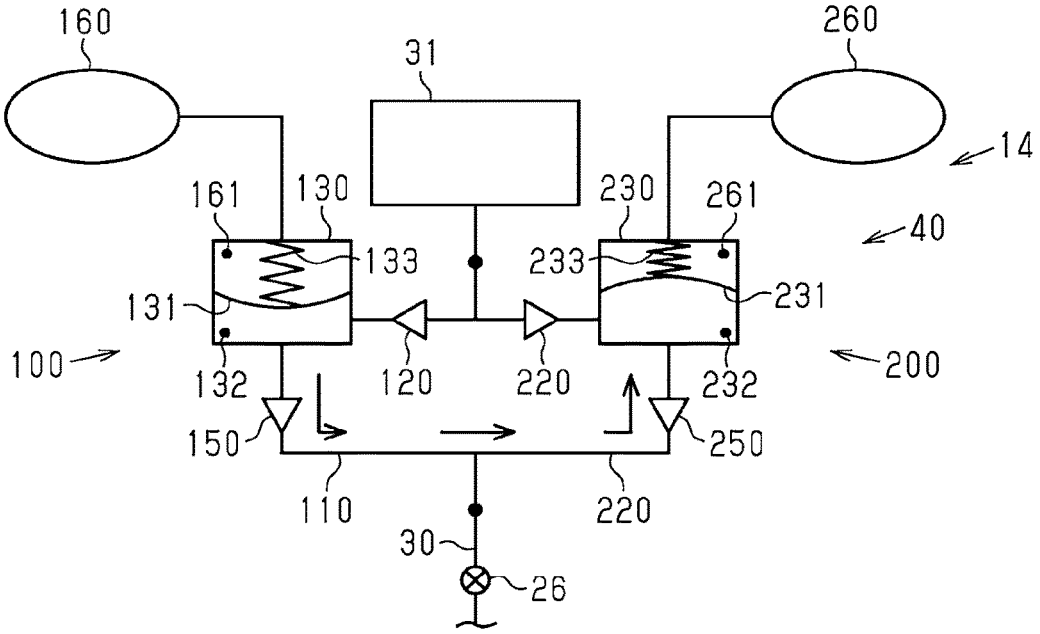
FIG. 6 is a schematic diagram of a supply unit illustrating backflow of liquid.

Assume the case where, as illustrated in FIG. 6, the liquid ejecting apparatus 11 is in the resting state; the diaphragm pump 130 of the first pressure-feeding unit 100 is in the discharging state; and the diaphragm pump 230 of the second pressure-feeding unit 200 is maintained in the sucking state. In this case, in the diaphragm pump 130 of the first pressure-feeding unit 100, the atmosphere opening valve 170 is in the open state, and therefore the diaphragm 131 is displaced toward the bottom dead center by the biasing force of the compression spring 133. When the diaphragm 131 is displaced toward the bottom dead center, liquid stored in the pump chamber 132 passes through the second one-way valve 150 and gradually flows out from the pump chamber 132 toward the downstream side.

Meanwhile, in the diaphragm pump 230 of the second pressure-feeding unit 200, the atmosphere opening valve 270 is in the closed state, and therefore the diaphragm 231 is displaced toward the top dead center due to the pressure difference between the negative pressure chamber 261 decompressed by the decompression pump 262 and the pump chamber 232. Here, in the case where the liquid ejecting apparatus 11 is in the resting state, since liquid is not ejected from the liquid ejecting unit 13, the flow path adapter 26 serving as an on-off valve for the common flow path 30 closes the common flow path 30. Therefore, as indicated by the three arrows illustrated in FIG. 6, liquid flowed out from the pump chamber 132 of the diaphragm pump 130 of the first pressure-feeding unit 100 flows to the pump chamber 232 of the diaphragm pump 230 of the second pressure-feeding unit 200 via the liquid supply flow paths 110 and 210. That is, liquid flows back through the second one-way valve 250 of the second pressure-feeding unit 200, and gradually flows into the pump chamber 232 from the downstream side. Then, as the time elapses, the storage amount of liquid stored in the pump chamber 132 of the diaphragm pump 130 of the first pressure-feeding unit 100 gradually decreases, while the storage amount of liquid stored in the pump chamber 232 of the diaphragm pump 230 of the second pressure-feeding unit 200 gradually increases.

The atmosphere opening valves 170 and 270 in this embodiment are configured to maintain negative pressure in the negative pressure chambers 161 and 261 by sealing between the atmosphere opening holes 171 and 271 and the valve elements 174 and 274 with the seal members 175 and 275, respectively. Accordingly, even when the atmosphere opening valves 170 and 270 are in the closed state, the air may gradually flow from the atmosphere opening holes 171 and 271 into the negative pressure chambers 161 and 261 due to the performance of the seal members 175 and 275, degradation over time, or the like, and the negative pressure in the negative pressure chambers 161 and 261 may be gradually reduced.

Figure 7:
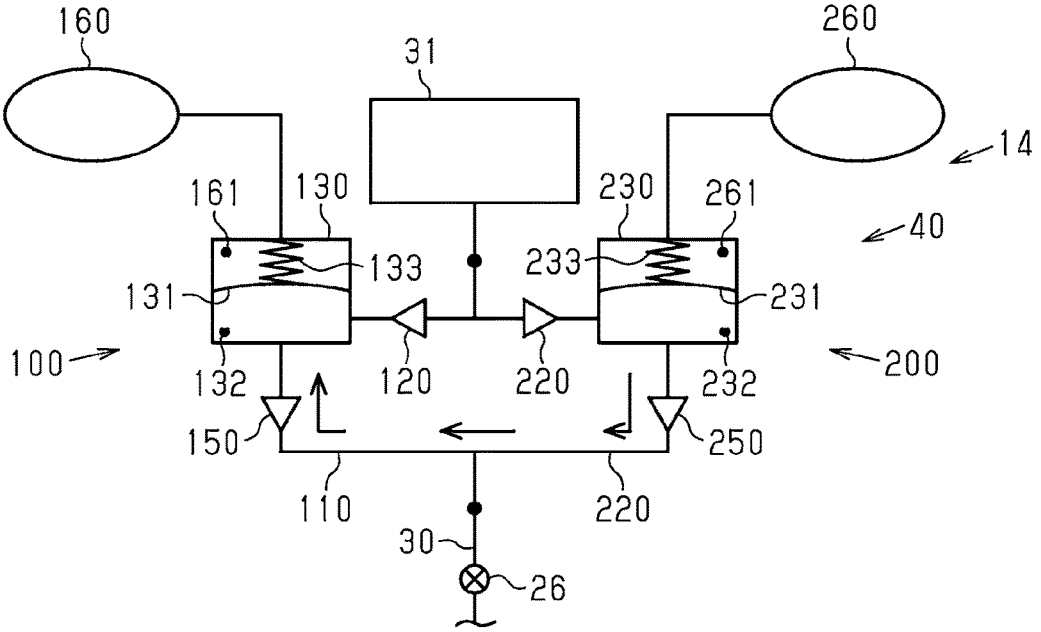
FIG. 7 is a schematic diagram of the supply unit illustrating backflow of liquid.

As illustrated in FIG. 7, in the diaphragm pump 230 of the second pressure-feeding unit 200, even when the atmosphere opening valve 270 connected to the negative pressure chamber 261 is in the closed state as illustrated in FIG. 3, the air gradually flows into the negative pressure chamber 261 via the atmosphere opening valve 270. When the air gradually flows into the negative pressure chamber 261 and the negative pressure in the negative pressure chamber 261 decreases, the diaphragm 231 is displaced toward the bottom dead center. When the diaphragm 231 is displaced toward the bottom dead center, the volume of the pump chamber 232 decreases, so that liquid gradually flows out from the pump chamber 232. The liquid flowed out from the pump chamber 232 of the diaphragm pump 230 of the second pressure-feeding unit 200 flows back through the second one-way valve 150 of the first pressure-feeding unit 100 via the liquid supply flow paths 110 and 210 as indicated by the three arrows in FIG. 7, and gradually flows into the pump chamber 132 of the first pressure-feeding unit 100. That is, when predetermined time elapses from when the driving of the electric motors 164 and 264 is stopped, the negative pressure in the negative pressure chamber 261 of the second pressure-feeding unit 200 decreases. Accordingly, the storage amount of liquid stored in the pump chamber 232 of the second pressure-feeding unit 200 gradually decreases, while the storage amount of liquid stored in the pump chamber 132 of the first pressure-feeding unit 100 gradually increases. Eventually, the negative pressure in the negative pressure chamber 261 of the second pressure-feeding unit 200 is eliminated, so that an equilibrium is attained in which the pressure is balanced between the pump chamber 132 of the diaphragm pump 130 of the first pressure-feeding unit 100 and the pump chamber 232 of the diaphragm pump 230 of the second pressure-feeding unit 200 and their storage amounts are close to each other.

Note that backflow of liquid occurs also when the liquid ejecting apparatus 11 is in the resting state; both the one diaphragm pump 130 and the other diaphragm pump 230 are in the discharging state; and the storage amounts of liquid in the pump chamber 132 and the pump chamber 232 are maintained to be different. In this case, since the negative pressure chamber 161 of the one diaphragm pump 130 and the negative pressure chamber 261 of the other diaphragm pump 230 are open to the atmosphere, an equilibrium is attained in which the pressure is balanced between the pump chamber 132 and the pump chamber 232 and their storage amounts are close to each other as illustrated in FIG. 7.

Figure 8:
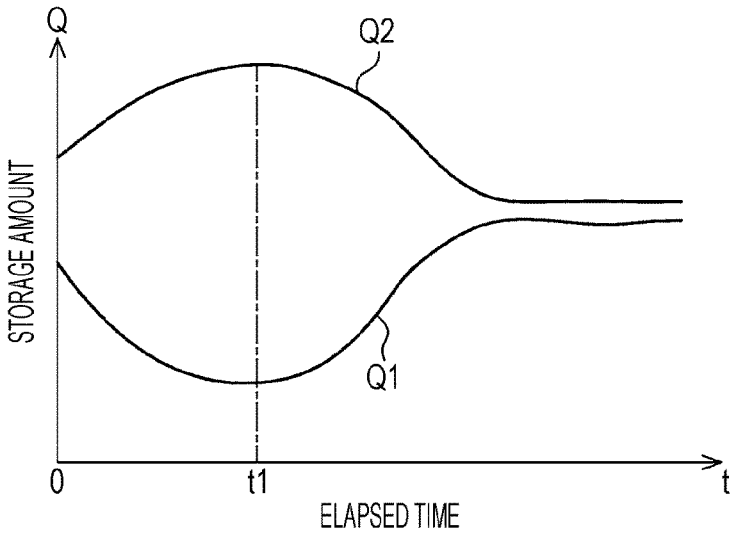
FIG. 8 illustrates graphs representing the storage amount of liquid stored in pump chambers.

FIG. 8 illustrates graphs representing liquid storage amounts Q of the pump chambers 132 and 232 that changes over time due to backflow of liquid in the first pressure-feeding unit 100 and the second pressure-feeding unit 200 described with reference to FIGS. 6 and 7. In FIG. 8, the lower graph represents a storage amount Q1 of liquid stored in the pump chamber 132 of the one diaphragm pump 130 in the discharging state, and the upper graph represents a storage amount Q2 of liquid stored in the pump chamber 232 of the other diaphragm pump 230 in the sucking state. Note that the graphs of FIG. 8 are obtained from experiments.

As illustrated in FIG. 8, the values of the graphs of the storage amount Q1 and the storage amount Q2 vary with elapsed time t. The elapsed time t indicates how much time has elapsed while the one diaphragm pump 130 (230) is in the discharging state and the other diaphragm pump 230 (130) is in the sucking state.

The storage amount Q1 gradually decreases from when the electric motors 164 and 264 are stopped to when predetermined time t1 elapses, and gradually increases toward a predetermined value after the predetermined time t1. The storage amount Q2 gradually increases from when the electric motors 164 and 264 are stopped to when the predetermined time t1 elapses, and gradually decreases toward the predetermined value after the predetermined time t1. That is, both the graphs of the storage amount Q1 and the storage amount Q2 have an inflection point at the predetermined time t1. After the predetermined time t1, the storage amount Q1 and the storage amount Q2 vary such that their values approach each other, and eventually are balanced at values close to each other.

Note that the second one-way valves 150 and 250 of this embodiment provide improved sealing performance due to provision of the second compression springs 153 and 253. However, if valves with relatively low sealing performance such as an umbrella valve and a leaf valve are used, for example, for reducing the size of the apparatus or reducing costs, backflow of liquid becomes more pronounced.

If the storage amounts Q of liquid in the pump chambers 132 and 232 vary while the liquid ejecting apparatus 11 is, for example, in the resting state, the supply amount of liquid by the diaphragm pumps 130 and 230 may be insufficient for the ejection amount of the liquid ejecting unit 13 when the next ejection operation starts. In this case, the liquid ejecting unit 13 may be unable to properly eject liquid, or properly discharge liquid. The problem that the supply amount is insufficient for the ejection amount can be solved by, for example, when a job that involves an ejection operation is input, causing the diaphragm pumps 130 and 230 to suck liquid to store a sufficient amount of liquid in the pump chambers 132 and 232 before execution of an ejection operation. However, in this case, since the diaphragm pumps 130 and 230 suck liquid each time a job is input, the number of times that the diaphragm pumps 130 and 230 are driven is increased, which may reduce the life of the diaphragm pumps 130 and 230.

In view of this, the liquid ejecting apparatus 11 of this embodiment calculates the storage amounts Q of liquid stored in the pump chambers 132 and 232, and appropriately drives the diaphragm pumps 130 and 230 based on the storage amounts Q.

First Embodiment

Next, the operation of the liquid ejecting apparatus 11 with the configuration described above according to a first embodiment will be described.

First, a pre-ejection-operation routine performed by the control unit 15 before an ejection operation will be described with reference to FIG. 9.

Figure 9:
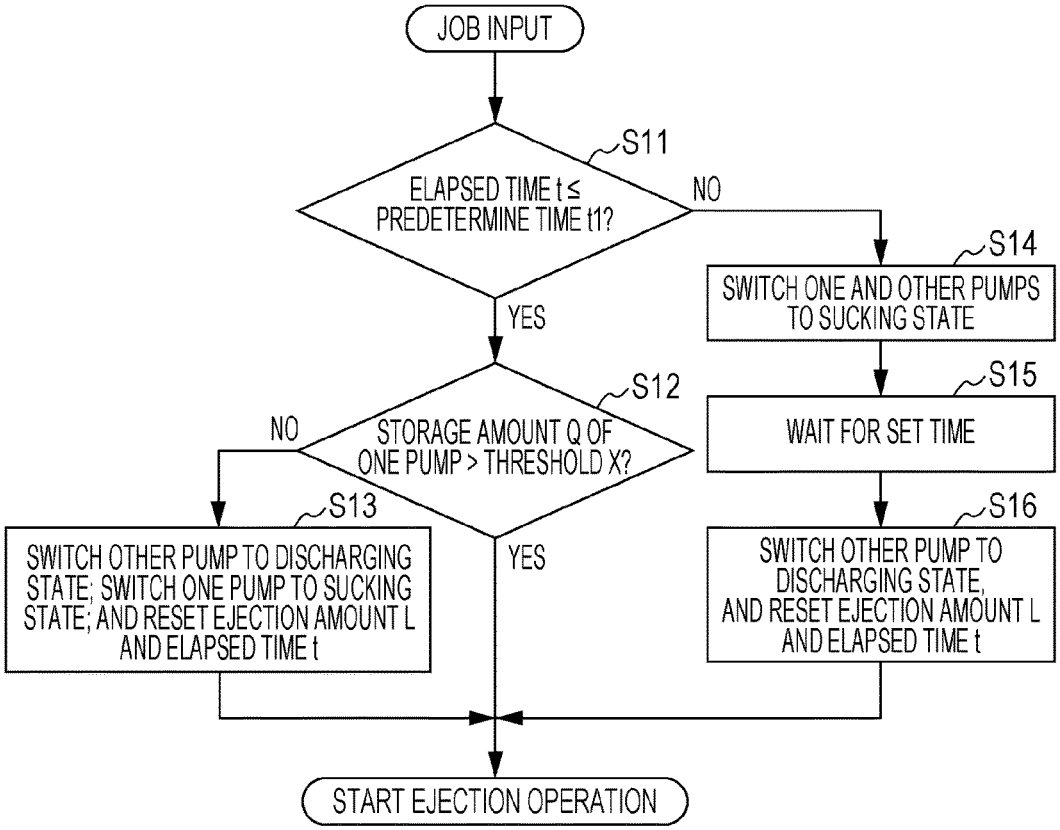
FIG. 9 is a flowchart illustrating a pre-ejection-operation routine according to a first embodiment.

As illustrated in FIG. 9, the liquid ejecting apparatus 11 has a routine that drives the diaphragm pumps 130 and 230 based on the storage amounts Q of liquid stored in the pump chambers 132 and 232, before an ejection operation. Note that, before an ejection operation, driving of the electric motors 164 and 264 is stopped. Further, for convenience of explanation, it is assumed herein that, in the initial state, the diaphragm pump 130 of the first pressure-feeding unit 100 is maintained in the discharging state, and the diaphragm pump 230 of the second pressure-feeding unit 200 is in the sucking state and can pressure-feed liquid to the liquid ejecting unit 13 by being switched to the discharging state (for example, the diaphragm 231 is located in the "top dead center" as illustrated in FIG. 6).

As illustrated in FIG. 9, in the liquid ejecting apparatus 11 in the resting state, the control unit 15 executes a pre-ejection-operation routine in response to an input of a job involving an ejection operation, such as a printing execution job and a cleaning execution job, for ejecting liquid from the liquid ejecting unit 13. First, in step S11, the control unit 15 determines whether the elapsed time t which is the elapsed time during which the one diaphragm pump 130 is in the discharging state and the other diaphragm pump 230 is in the sucking state is equal to or less than the predetermined time t1. If the elapsed time t is equal to or less than the predetermined time t1, the process proceeds to step S12. If the elapsed time t is greater than the predetermined time t1, the process proceeds to step S14.

If YES is determined in step S11, the control unit 15 determines whether the storage amount Q of liquid stored in the pump chamber 132 of the one diaphragm pump 130 maintained in the discharging state is greater than a threshold X in step S12. The storage amount Q is calculated based on an ejection amount L of liquid ejected by the liquid ejecting unit 13, and an inflow M of liquid flowed from the pump chamber 132 of the one diaphragm pump 130 to the pump chamber 232 of the other diaphragm pump 230.

The ejection amount L is the amount of liquid ejected by the liquid ejecting unit 13, during a period in which the one diaphragm pump 130 is in the discharging state. More specifically, the ejection amount L is the amount of liquid ejected by the liquid ejecting unit 13, during a period from when the one diaphragm pump 130 is switched from the sucking state to the discharging state to when the liquid ejecting apparatus 11 is switched to the resting state. The control unit 15 calculates the ejection amount L, by converting the weight based on the shot count of liquid ejected by the liquid ejecting unit 13 and the value of the ejection weight.

The inflow M is the amount of liquid flowing from the one diaphragm pump 130 maintained in the discharging state into the other diaphragm pump 230. The inflow M is calculated by multiplying a preset set value N, which is set in advance in the control unit 15, by the elapsed time t. The set value N is a fixed value obtained from experiments, and is recorded in the control unit 15 as the amount of liquid flowing back per unit time. That is, the set value N corresponds to the absolute value of the inclination obtained by linearly approximating the graph of the storage amount Q1 of FIG. 8 in the range where the elapsed time t is "$0<t<t1$".

The control unit 15 calculates a discharge amount V, which is the amount of liquid discharged from the one diaphragm pump 130 in the discharging state during a period of the discharging state, by adding the inflow M to the ejection amount L. The control unit 15 calculates the storage amount Q by subtracting the discharge amount V from a maximum storage amount Qmax of the pump chamber 132 of the diaphragm pump 130. That is, the control unit 15 calculates the storage amount Q as "$Q=Qmax-(L+N\times t)$" based on the discharge amount V.

In summary, in step S12, the control unit 15 determines whether "$Q>X$". If "$Q>X$", the control unit 15 determines that a sufficient amount of liquid is stored in the pump chamber 132 of the one diaphragm pump 130 maintained in the discharging state, and causes the liquid ejecting unit 13 to start an ejection operation while maintaining the diaphragm pumps 130 and 230 in their current states. If "$Q\leq X$", the process proceeds to step S13.

If NO is determined in step S12, the process proceeds to step S13. Note that in this embodiment, in the initial state, the other diaphragm pump 230 is already in the sucking state. Accordingly, in the first embodiment, if No is determined in step S12, the ejection operation can be started, without waiting for a set time, unlike step S18 (see FIG. 12) of the second embodiment described below.

In step S13, the control unit 15 switches the other diaphragm pump 230 to the discharging state, switches the one diaphragm pump 130 to the sucking state, and resets the count of the ejection amount L and the elapsed time t. That is, the control unit 15 drives the electric motor 264 in the reverse rotation direction, and opens the atmosphere opening valve 270 so as to open the negative pressure chamber 261 to the atmosphere. The control unit 15 drives the electric motor 164 in the normal rotation direction, and places the negative pressure chamber 161 under negative pressure to suck liquid into the pump chamber 132. In summary, in this embodiment, in parallel to the operation of switching the other diaphragm pump 230 (130) from the sucking state to the discharging state (the operation of placing the other pump in the discharging state), the operation of switching the one diaphragm pump 130 (230) from the discharging state to the sucking state is performed.

In step S13, the control unit 15 causes the liquid ejecting unit 13 to start the ejection operation, after the other diaphragm pump 230 is switched to the discharging state. The ejection amount L that is reset in step S13 is calculated again by converting the weight based on the shot count of liquid ejected by the liquid ejecting unit 13 from when the other diaphragm pump 230 is switched from the sucking state to the discharging state and the value of the ejection weight. The calculated ejection amount L serves as a parameter for calculating the storage amount Q of the other diaphragm pump 230 that is switched to the discharging state. Further, the elapsed time t that is reset in step S13 starts to be counted when the other diaphragm pump 230 is switched from the sucking state to the discharging state, and is used to calculate the inflow M of liquid flowing from the other diaphragm pump 230 to the one diaphragm pump 130.

In this embodiment, the operation of switching the other diaphragm pump 230 (130) from the sucking state to the discharging state (the operation of placing the other diaphragm in the discharging state) when the storage amount Q of the one diaphragm pump 130 (230) in the discharging state falls to or below the threshold X is referred to as a first pump operation. That is, the operation of the other pump in step S13 of FIG. 9 corresponds to the first pump operation.

If NO is determined in step S11, the control unit 15 causes both the one diaphragm pump 130 and the other diaphragm pump 230 to suck liquid in step S14. That is, the control unit 15 drives both the electric motors 164 and 264 in the normal rotation direction, and places the negative pressure chambers 161 and 261 under negative pressure to suck liquid into the pump chambers 132 and 232, respectively. This is because, as illustrated in FIG. 8, even in the case where the other diaphragm pump 230 is maintained in the sucking state, when the elapsed time t exceeds the predetermined time t1, the storage amount Q of the pump chamber 232 of the other diaphragm pump 230 increases or decreases due to the liquid flowing back via the second one-way valve 250 and the air flowing into the negative pressure chamber 261, and it becomes impossible to calculate the storage amount Q. In other words, the control unit 15 resets the storage amount Q by placing both the diaphragm pumps 130 and 230 in the sucking state.

In this embodiment, an operation of causing the one diaphragm pump 130 and the other diaphragm pump 230 to suck liquid if the elapsed time t is greater than the predetermined time t1 is referred to as a second pump operation. That is, the processing operations in steps S11 and S14 of FIG. 9 correspond to the second pump operation.

Then, in step S15, the control unit 15 waits for a preset set time while keeping the one and the other diaphragm pumps 130 and 230 sucking liquid. That is, the one diaphragm pump 130 and the other diaphragm pump 230 continue to suck liquid from the liquid supply source 31 during the preset set time. This set time is the time required for the diaphragm pumps 130 and 230 to suck a sufficient amount of liquid. For example, the set time is the time required for the diaphragms 131 and 231 located in the bottom dead centers to be displaced to the top dead centers, that is, the time taken for the storage amount of the pump chambers 132 and 232 to increase from the minimum value to the maximum value. A sufficient amount of liquid is sucked in the pump chambers 132 and 232 of the diaphragm pumps 130 and 230 by continuing to drive the electric motors 164 and 264 in the normal rotation direction, respectively, during the preset set time.

Subsequently, in step S16, the control unit 15 switches the other diaphragm pump 230 from the sucking state to the discharging state, and resets the count of the ejection amount L and the elapsed time t. That is, the control unit 15 drives the electric motor 264 in the reverse rotation direction, and opens the atmosphere opening valve 270 so as to open the negative pressure chamber 261 to the atmosphere. In this step, the one diaphragm pump 130 is maintained in the sucking state. Note that, in step S16, the control unit 15 may control the diaphragm pumps 130 and 230 to switch the one diaphragm pump 130 from the sucking state to the discharging state. In this case, the other diaphragm pump 230 is maintained in the sucking state. In step S16, the control unit 15 may perform control that switches either one of the diaphragm pumps 130 and 230 from the sucking state to the discharging state.

In step S16, the control unit 15 causes the liquid ejecting unit 13 to start the ejection operation, after the other diaphragm pump 230 is switched to the discharging state. Accordingly, the ejection amount L that is reset in step S16 is calculated again by converting the weight based on the shot count of liquid ejected by the liquid ejecting unit 13 from when the other diaphragm pump 230 is switched from the sucking state to the discharging state and the value of the ejection weight. The calculated ejection amount L serves as a parameter for calculating the storage amount Q of the other diaphragm pump 230 that is switched to the discharging state. Further, the elapsed time t that is reset in step S16 starts to be counted when the other diaphragm pump 230 is switched from the sucking state to the discharging state, and is used to calculate the inflow M of liquid flowing from the other diaphragm pump 230 to the one diaphragm pump 130.

In this manner, the liquid ejecting apparatus 11 performs a pump operation appropriate to the situation, based on the storage amounts Q of liquid stored in the pump chambers 132 and 232 of the diaphragm pumps 130 and 230, before an ejection operation.

Next, a during-ejection-operation routine performed by the control unit 15 during an ejection operation will be described with reference to FIG. 10. For convenience of explanation, it is assumed that, in the initial state, the diaphragm pump 230 of the second pressure-feeding unit 200 is in the discharging state, and the diaphragm pump 130 of the first pressure-feeding unit 100 is in the sucking state and can pressure-feed liquid to the liquid ejecting unit 13 by being switched to the discharging state (for example, the diaphragm 131 is located in the "top dead center"). Note that while the during-ejection-operation routine is executed, the liquid ejecting unit 13 performs the ejection operation. Further, the predetermined time t1 of FIG. 8 does not elapse while the liquid ejecting unit 13 is performing the ejection operation.

Figure 10:
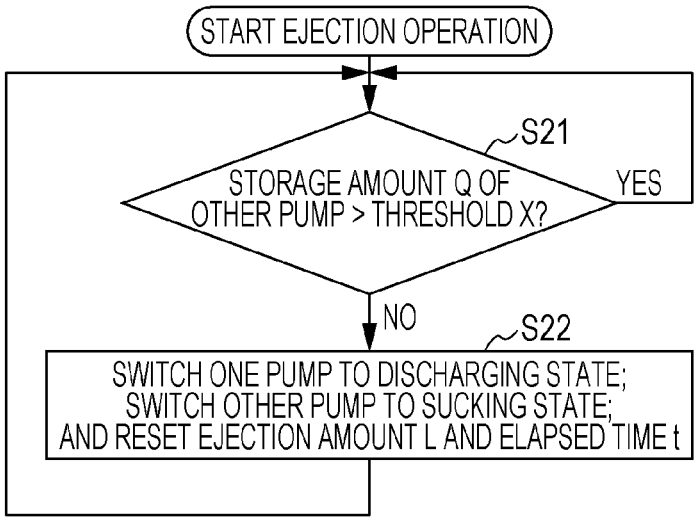
FIG. 10 is a flowchart illustrating a during-ejection-operation routine according to the first embodiment.

As illustrated in FIG. 10, when the liquid ejecting apparatus 11 starts an ejection operation, the control unit 15 first determines in step S21 whether the storage amount Q of the other diaphragm pump 230 in the discharging state is greater than a threshold X. This threshold X has the same value as that in step S12 of the first embodiment. If "Q>X", then the step S21 is repeated. If "Q≤X", the process proceeds to step S22. Note that, as in the case of the resting state, the storage amount Q during the ejection operation is also calculated as "Q=Qmax−(L+N×t)". If NO is determined in step S21, the process proceeds to step S22.

In step S22, the control unit 15 switches the one diaphragm pump 130 to the discharging state, switches the other diaphragm pump 230 to the sucking state, and resets the count of the ejection amount L and the elapsed time t. That is, the control unit 15 drives the electric motor 164 in the reverse rotation direction, and opens the atmosphere opening valve 170 so as to open the negative pressure chamber 161 to the atmosphere. The control unit 15 drives the electric motor 264 in the normal rotation direction, and places the negative pressure chamber 261 under negative pressure to suck liquid into the pump chamber 232. The liquid ejecting unit 13 continues the ejection operation even after the one diaphragm pump 130 is switched to the discharging state. Therefore, the ejection amount L that is reset in step S22 is calculated again by converting the weight based on the shot count of liquid ejected by the liquid ejecting unit 13 from when the one diaphragm pump 130 is switched from the sucking state to the discharging state and the value of the ejection weight. The calculated ejection amount L serves as a parameter for calculating the storage amount Q of the one diaphragm pump 130 that is switched to the discharging state. Further, the elapsed time t that is reset in step S22 starts to be counted when the one diaphragm pump 130 is switched from the sucking state to the discharging state, and is used to calculate the inflow M of liquid flowing from the one diaphragm pump 130 to the other diaphragm pump 230.

Note that the operation of the one pump in step S22 of FIG. 10 corresponds to the first pump operation described above. That is, the first pump operation is performed before and during the ejection operation. Further, in this embodiment, in parallel to the operation of switching one diaphragm pump 130 (230) from the sucking state to the discharging state (the operation of placing one pump in the discharging state) is performed, the operation of switching the other diaphragm pump 230 (130) from the discharging state to the sucking state is performed, in the same manner as that before the ejection operation.

To summarize the operations in steps S21 and S22, the control unit 15 immediately switches the one diaphragm pump 130 from the sucking state to the discharging state when the storage amount Q of the other diaphragm pump 230 in the discharging state reaches the threshold X. That is, by switching the states of the one and the other diaphragm pumps 130 and 230 in parallel, liquid is continuously supplied from the liquid supply source 31 toward the liquid ejecting unit 13. Accordingly, the threshold X in the first embodiment only needs to be set to a value equal to or greater than the amount with which the diaphragm pumps 130 and 230 are in the discharging state but become unable to pressure-feed liquid to the liquid ejecting unit 13.

When the control unit 15 ends the processing operation of step S22, the process returns again to step S21 to repeatedly execute the during-ejection-operation routine. The control unit 15 repeats the during-ejection-operation routine described above while the liquid ejecting unit 13 performs the ejection operation. When the ejection operation is completed, the control unit 15 immediately ends the during-ejection-operation routine, and executes a post-ejection-operation routine of FIG. 11.

Next, a post-ejection-operation routine performed by the control unit 15 after an ejection operation will be described with reference to FIG. 11.

Figure 11:
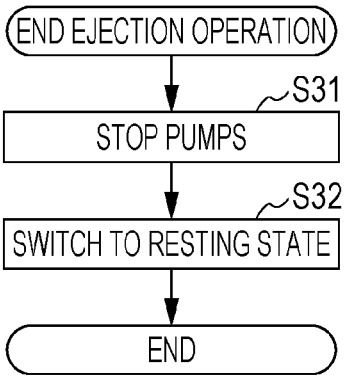
FIG. 11 is a flowchart illustrating a post-ejection-operation routine.

As illustrated in FIG. 11, when the ejection operation of the liquid ejecting unit 13 completes, the control unit 15 stops driving the diaphragm pumps 130 and 230 in step S31. When the electric motors 164 and 264 stop, the diaphragm pumps 130 and 230 are maintained in their states at the time of completion of the ejection operation, that is, the discharging state if in the discharging state at that time, or the sucking state if in the sucking state at that time.

Then, in step S32, the control unit 15 switches the liquid ejecting apparatus 11 to the resting state while maintaining the diaphragm pumps 130 and 230 in the discharging state or the sucking state. After switching the liquid ejecting apparatus 11 to the resting state, the control unit 15 ends the post-ejection-operation routine.

Second Embodiment

Next, the operation of the liquid ejecting apparatus 11 with the configuration described above according to a second embodiment will be described. The following description will focus on the differences from the first embodiment. The elements that are the same as those of the first embodiment are denoted by the same reference numerals, and the description thereof will be omitted.

First, a pre-ejection-operation routine performed by the control unit 15 before an ejection operation will be described with reference to FIG. 12.

Figure 12:
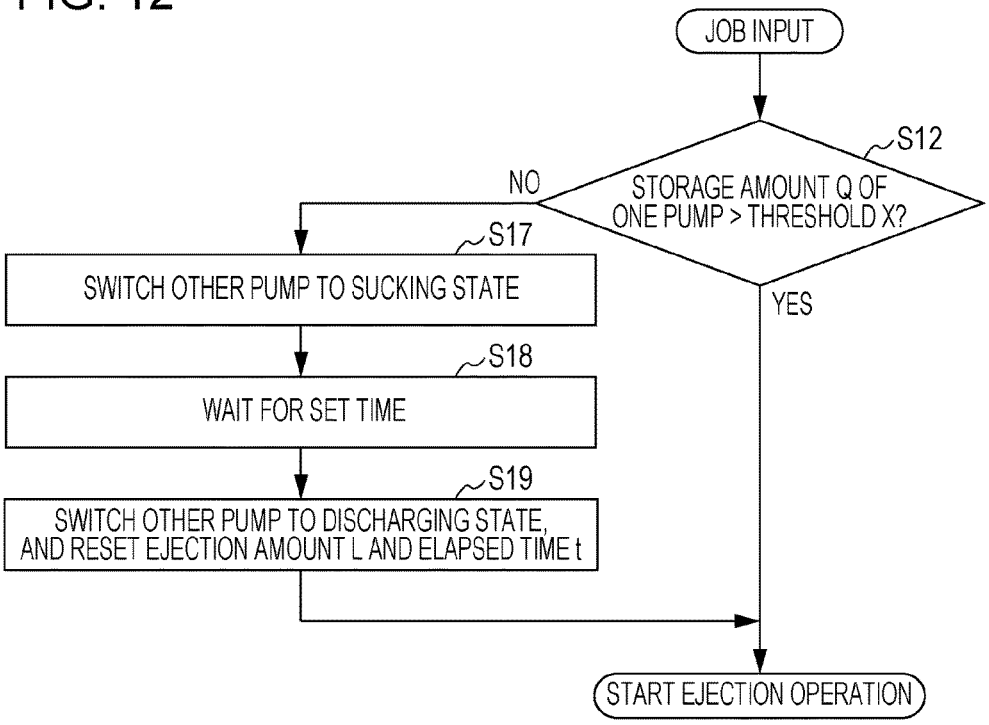
FIG. 12 is a flowchart illustrating a pre-ejection-operation routine according to a second embodiment.

As illustrated in FIG. 12, the liquid ejecting apparatus 11 has a routine that drives the diaphragm pumps 130 and 230 based on the storage amounts Q of liquid stored in the pump chambers 132 and 232, before an ejection operation. Note that, before an ejection operation, driving of the electric motors 164 and 264 is stopped. Further, for convenience of explanation, it is assumed herein that, in the initial state, the diaphragm pump 130 of the first pressure-feeding unit 100 is maintained in the discharging state, and the diaphragm pump 230 of the second pressure-feeding unit 200 is in the discharging state but cannot pressure-feed liquid to the liquid ejecting unit 13 (for example, the diaphragm 231 is located in the "bottom dead center" as illustrated in FIG. 3).

As illustrated in FIG. 12, in the liquid ejecting apparatus 11 in the resting state, the control unit 15 executes a pre-ejection-operation routine in response to an input of a job involving an ejection operation, such as a printing execution job and a cleaning execution job, for ejecting liquid from the liquid ejecting unit 13. In this embodiment, in the initial state, the other diaphragm pump 230 is not maintained in the sucking state unlike the first embodiment. Therefore, the changes in the storage amount Q1 and the storage amount Q2 after the predetermined time t1 in FIG. 8 do not need to be taken into consideration. Therefore, in the pre-ejection-operation routine in the second embodiment, the processing of step S11 of the first embodiment is not needed. Accordingly, in this embodiment, the operations in steps S14 to S16 are not needed either.

In step S12, the control unit 15 determines whether the storage amount Q of liquid stored in the pump chamber 132 of the one diaphragm pump 130 maintained in the discharging state is greater than the threshold X. As in the first embodiment, the storage amount Q is calculated based on the ejection amount L of liquid ejected by the liquid ejecting unit 13, and the inflow M of liquid flowed from the pump chamber 132 of the one diaphragm pump 130 to the pump chamber 232 of the other diaphragm pump 230.

In step S12, the control unit 15 determines whether "Q>X". If "Q>X", the control unit 15 determines that a sufficient amount of liquid is stored in the pump chamber 132 of the one diaphragm pump 130 maintained in the discharging state, and causes the liquid ejecting unit 13 to start an ejection operation while maintaining the diaphragm pumps 130 and 230 in their current states. If "Q≤X", the process proceeds to step S17.

If NO is determined in step S12, the control unit 15 switches the other diaphragm pump 230 to the sucking state in step S17. That is, the control unit 15 drives the electric motor 264 in the normal rotation direction, and places the negative pressure chamber 261 under negative pressure to suck liquid into the pump chamber 232. This is because in the case where the storage amount Q of liquid stored in the pump chamber 132 of the one diaphragm pump 130 in the discharging state is equal to or less than the threshold X, if the ejection operation is started without performing the operations described above, the amount of liquid stored in the one diaphragm pump 130 in the discharging state might be insufficient for the amount of liquid to be discharged by the liquid ejecting unit 13.

Then, in step S18, the control unit 15 waits for a preset set time while keeping the other diaphragm pump 230 sucking liquid. That is, the other diaphragm pump 230 continues to suck liquid from the liquid supply source 31 during the preset set time. This set time is the time required for the diaphragm pumps 130 and 230 to suck a sufficient amount of liquid. In this embodiment, the set time is the time required for the diaphragms 131 and 231 located in the bottom dead centers to be displaced to the top dead centers, that is, the time taken for the storage amount of the pump chambers 132 and 232 to increase from the minimum value to the maximum value. Thus, in step S18, the other diaphragm pump 230 sucks liquid until the storage amount Q of liquid in the pump chamber 232 reaches the maximum storage amount Qmax.

Subsequently, in step S19, the control unit 15 switches the other diaphragm pump 230 to the discharging state, and resets the count of the ejection amount L and the elapsed time t. That is, the control unit 15 drives the electric motor 264 in the reverse rotation direction, and opens the atmosphere opening valve 270 so as to open the negative pressure chamber 261 to the atmosphere. The control unit 15 causes the liquid ejecting unit 13 to start the ejection operation, after the other diaphragm pump 230 is switched to the discharging state. The ejection amount L that is reset in step S19 is calculated again by converting the weight based on the shot count of liquid ejected by the liquid ejecting unit 13 from when the other diaphragm pump 230 is switched from the sucking state to the discharging state and the value of the ejection weight. The calculated ejection amount L serves as a parameter for calculating the storage amount Q of the other diaphragm pump 230 that is switched to the discharging state. Further, the elapsed time t that is reset in step S19 starts to be counted when the other diaphragm pump 230 is switched from the sucking state to the discharging state, and is used to calculate the inflow M of liquid flowing from the other diaphragm pump 230 to the one diaphragm pump 130.

In this embodiment, the operation of switching the other diaphragm pump 230 (130) from the sucking state to the discharging state (the operation of placing the other diaphragm in the discharging state) when the storage amount Q of the one diaphragm pump 130 (230) in the discharging state falls to or below the threshold X is referred to as a first pump operation. That is, the operations of the other pump in steps S12 and S19 of FIG. 12 correspond to the first pump operation.

Next, a during-ejection-operation routine performed by the control unit 15 during an ejection operation will be described with reference to FIG. 13. For convenience of explanation, it is assumed that, in the initial state, the diaphragm pump 230 of the second pressure-feeding unit 200 is in the discharging state, and the diaphragm pump 130 of the first pressure-feeding unit 100 is in the discharging state but cannot pressure-feed liquid to the liquid ejecting unit 13 (for example, the diaphragm 131 is located in the "bottom dead center" as illustrated in FIG. 3). Note that while the during-ejection-operation routine is executed, the liquid ejecting unit 13 performs the ejection operation.

Further, in this embodiment, in the initial state, the one diaphragm pump 130 is not maintained in the sucking state unlike the first embodiment. Therefore, the changes in the storage amount Q1 and the storage amount Q2 after the predetermined time t1 in FIG. 8 do not need to be taken into consideration.

Figure 13:
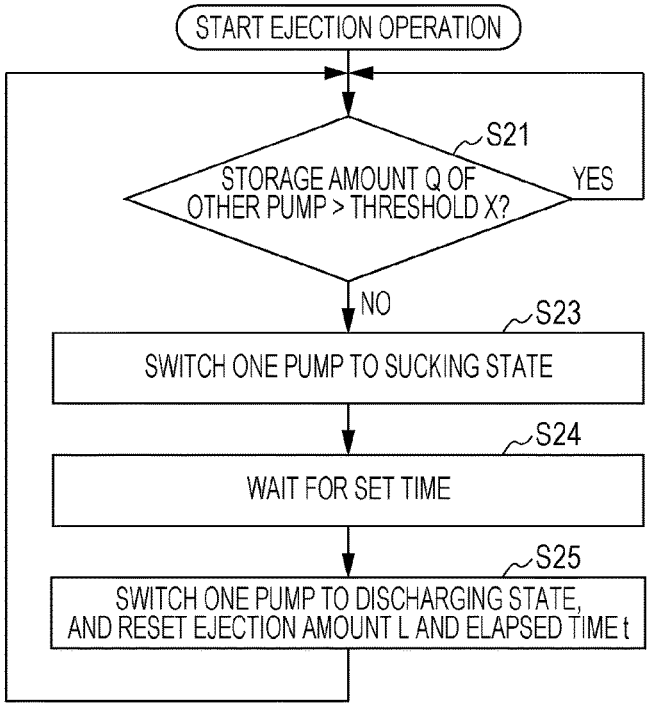
FIG. 13 is a flowchart illustrating a during-ejection-operation routine according to the second embodiment.

As illustrated in FIG. 13, when the liquid ejecting apparatus 11 starts an ejection operation, the control unit 15 first determines in step S21 whether the storage amount Q of the other diaphragm pump 230 in the discharging state is greater than the threshold X. This threshold X has the same value as that in step S12 of the second embodiment. If "Q>X", then the step S21 is repeated. If "Q≤X", the process proceeds to step S23. Note that, as in the case of the resting state, the storage amount Q during the ejection operation is also calculated as "Q=Qmax−(L+N×t)".

If NO is determined in step S21, the control unit 15 switches the one diaphragm pump 130 to the sucking state in step S23. That is, the control unit 15 drives the electric motor 164 in the normal rotation direction, and places the negative pressure chamber 161 under negative pressure to suck liquid into the pump chamber 132.

Then, in step S24, the control unit 15 waits for a preset set time while keeping the one diaphragm pump 130 sucking liquid. This set time is set to the same value as that of step S18. As described with respect to the processing operation of step S18, a sufficient amount of liquid is sucked in the pump chamber 132 of the one diaphragm pump 130 by continuing to drive the electric motor 164 in the normal rotation direction, during the preset set time.

Subsequently, in step S25, the control unit 15 switches the one diaphragm pump 130 to the discharging state, and resets the count of the ejection amount L and the elapsed time t. That is, the control unit 15 drives the electric motor 164 in the reverse rotation direction, and opens the atmosphere opening valve 170 so as to open the negative pressure chamber 161 to the atmosphere. The liquid ejecting unit 13 continues the ejection operation even after the one diaphragm pump 130 is switched to the discharging state. The ejection amount L that is reset in step S25 is calculated again by converting the weight based on the shot count of liquid ejected by the liquid ejecting unit 13 from when the one diaphragm pump 130 is switched from the sucking state to the discharging state and the value of the ejection weight. The calculated ejection amount L serves as a parameter for calculating the storage amount Q of the one diaphragm pump 130 that is switched to the discharging state. Further, the elapsed time t that is reset in step S25 starts to be counted when the one diaphragm pump 130 is switched from the sucking state to the discharging state, and is used to calculate the inflow M of liquid flowing from the one diaphragm pump 130 to the other diaphragm pump 230.

Note that the operations of the one pump in steps S21 and S25 of FIG. 13 correspond to the first pump operation described above. That is, the first pump operation is performed before and during the ejection operation.

To summarize the operations in steps S21 and S23 to S25, the control unit 15 switches the one diaphragm pump 130 from the sucking state to the discharging state after a set time from when the storage amount Q of the other diaphragm pump 230 in the sucking state reaches the threshold X. That is, in order to continuously supply liquid from the liquid supply source 31 toward the liquid ejecting unit 13, the other diaphragm pump 230 needs to be able to continuously discharge liquid toward the liquid ejecting unit 13 during this set time. Accordingly, the threshold X in this embodiment is set to satisfy this condition.

The threshold X is defined as the amount of liquid that the other diaphragm pump 230 can discharge liquid toward the liquid ejecting unit 13 during a period from when the one diaphragm pump 130 sucks liquid to when the one diaphragm pump 130 is switched to the discharging state. For example, assume the case where the storage amount with which the diaphragm pumps 130 and 230 become unable to discharge liquid toward the liquid ejecting unit 13 is "0.1 (g)"; the maximum discharge amount toward the liquid ejecting unit 13 per unit time is "0.05 (g/s)"; and the set time in step S24 is "1 second". In this case, the amount of liquid needed by the other diaphragm pump 230 during the period from when the one diaphragm pump 130 sucks liquid to when the one diaphragm pump 130 is switched to the discharging state is "0.1+0.05×1=0.15 (g)". That is, when liquid of "0.15 (g)" or greater is stored in the other diaphragm pump 230, liquid can be supplied to the liquid ejecting unit 13 from the other diaphragm pump 230 even when the one diaphragm pump 130 is performing a sucking operation. In other words, in this case, if the threshold X is set to a value equal to or greater than "0.15 (g)", it is possible to continuously supply liquid from the liquid supply source 31 toward the liquid ejecting unit 13, using the diaphragm pumps 130 and 230.

When the control unit 15 ends the processing operation of step S25, the process returns again to step S21 to repeatedly execute the during-ejection-operation routine. The control unit 15 repeats the during-ejection-operation routine described above while the liquid ejecting unit 13 performs the ejection operation. When the ejection operation is completed, the control unit 15 immediately ends the during-ejection-operation routine, and executes the post-ejection-operation routine of FIG. 11. Note that the post-ejection-operation routine of the second embodiment is the same as that of the first embodiment illustrated in FIG. 11. Therefore, the description thereof is omitted.

According to the first embodiment and the second embodiment described above, the following effects can be obtained.

(1) Since the diaphragm pumps 130 and 230 are operated based on the threshold X, it is possible to optimize the operation of the diaphragm pumps 130 and 230, and hence to reduce the number of times the diaphragm pumps 130 and 230 are driven. This extends the life of the diaphragm pumps 130 and 230. Accordingly, it is possible to provide better usability than before.

(2) Since the first pump operation is performed during the ejection operation of ejecting liquid from the liquid ejecting unit 13, it is possible to continuously pressure-feed liquid to the liquid ejecting unit 13 during the ejection operation.

(3) Before performing the ejection operation of ejecting liquid from the liquid ejecting unit 13, if the storage amount Q of liquid stored in the pump chamber 132 (232) of one diaphragm pump 130 (230) is less than the threshold X, the first pump operation is performed. That is, by supplying liquid to the liquid ejecting unit 13 in advance before performing the ejection operation, it is possible to continuously pressure-feed liquid to the liquid ejecting unit 13 during the ejection operation.

(4) The inflow M of liquid is calculated by multiplying the predetermined set value N by the elapsed time t during which one diaphragm pump 130 (230) is in the discharging state and the other diaphragm pump 230 (130) is in the sucking state. That is, this configuration can be preferably adopted as a method of calculating the inflow M of liquid flowed from the pump chamber 132 (232) of the one diaphragm pump 130 (230) in the discharging state into the pump chamber 232 (132) of the other diaphragm pump 230 (130) in the sucking state.

(5) The diaphragm pumps 130 and 230 include, respectively, the first one-way valves 120 and 220, the second one-way valves 150 and 250, the diaphragms (displacement units) 131 and 231, the decompression pumps (displacement mechanisms) 162 and 262, and compression springs (biasing members) 133 and 233. The diaphragm pumps 130 and 230 alternately repeat the sucking state and the discharging state by increasing and reducing the volumes of the pump chambers 132 and 232, respectively. Accordingly, this configuration can be preferably adopted as the configuration of the diaphragm pumps 130 and 230 that suck and discharge liquid.

(6) The displacement mechanisms are the decompression pumps 162 and 262 that displace the diaphragms (displacement units) 131 and 231 in the direction of increasing the volumes of the pump chambers 132 and 232 by decompressing the spaces adjacent to the diaphragms (displacement units) 131 and 231. Before performing the ejection operation of ejecting liquid from the liquid ejecting unit 13, if the elapsed time t during which the other diaphragm pump 230 is in the sucking state is greater than a preset time, the second pump operation of causing the one diaphragm pump 130 and the other diaphragm pump 230 to suck liquid is performed. Accordingly, it is possible to increase the accuracy of calculating the volume of the pump chamber 132 (232) of the diaphragm pump 130 (230) in the discharging state.

(7) The flow path adapter 26 is provided. The flow path adapter 26 serves as an on-off valve that switches a restricted state in which liquid is restricted from flowing through the common flow path 30 to a communicating state in which liquid is allowed to flow when the amount of liquid in the storage unit (liquid chamber) 25 provided in the common flow path 30 decreases. Accordingly, this configuration can be preferably adopted as the configuration for supplying liquid to the liquid ejecting unit 13.

The following modifications may be made to the above embodiments. The following modifications may be appropriately made in combination.

In the first embodiment, it is not necessary to perform in parallel the operation of switching one diaphragm pump 130 (230) from the sucking state to the discharging state (placing one pump in the discharging state) and the operation of switching the other diaphragm pump 230 (130) from the discharging state to the sucking state. For example, the operation of switching one diaphragm pump 130 (230) from the sucking state to the discharging state (placing one pump in the discharging state) may be performed and then, after the elapse of a set time, the operation of switching the other diaphragm pump 230 (130) from the discharging state to the sucking state may be performed. Further, before the ejection operation is performed, the operation of switching one diaphragm pump 130 (230) from the sucking state to the discharging state (placing one pump in the discharging state) may be performed. Then, after the elapse of a set time, the operation of switching the other diaphragm pump 230 (130) from the discharging state to the sucking state may be performed.

In the above embodiments, the pumps may be configured to, for example, suck liquid from the liquid supply source 31 in response to the pressure of the pump chambers 132 and 232 being directly reduced, and discharge liquid toward the liquid ejecting unit 13 in response to the pressure of the pump chambers 132 and 232 being directly increased. That is, the pumps may be configured to repeat alternately the sucking state and the discharging state by reducing and increasing the pressure in the pump chambers 132 and 232, and thereby supply liquid to the downstream side.

In the above embodiments, when calculating the storage amount Q of liquid stored in one pump chamber 132 (232), the inflow of liquid that enters from the other pump chamber 232 (132) via the first one-way valves 120 and 220 may be taken into account.

In the above embodiments, when calculating the storage amount Q of liquid stored in one pump chamber 132 (232), the inflow of liquid that flows from the one pump chamber 132 (232) toward the liquid supply source 31 may be taken into account.

In the above embodiments, the on-off valve (flow path adapter 26) serving as the pressure regulating valve provided in the common flow path 30 may be, for example, a solenoid valve.

In the above embodiments, the diaphragm pumps 130 and 230 may be configured to suck and discharge liquid by displacing directly the diaphragms 131 and 231 using machine parts such as rods, for example. In this case, there is no need to provide the atmosphere opening valves 170 and 270, and there is no risk of the negative pressure in the negative pressure chambers 161 and 261 being eliminated by the air entering from the atmosphere opening holes 171 and 271, respectively, while the liquid ejecting apparatus 11 is in the resting state. Therefore, in this case, the graphs of the storage amount Q1 and the storage amount Q2 in FIG. 8 remain flat after the predetermined time t1. That is, there is no need to perform step S11 of FIG. 9, and hence no need to perform the second pump operation.

In the above embodiments, the volumes of the pump chambers 132 and 232 of the diaphragm pumps 130 and 230 do not have to be the same.

In the above embodiments, the threshold X in the first embodiment and the threshold X in the second embodiment may have the same value.

In the above embodiments, when calculating the storage amount Q of liquid stored in the one pump chamber 132 (232), the inflow M may be taken into account even when the liquid ejecting apparatus 11 is performing an ejection operation. In this case, a set value different from the set value N may be set as the amount of backflow during the ejection operation.

In the above embodiments, when sucking liquid, the diaphragms 131 and 231 of the diaphragm pumps 130 and 230 do not have to be displaced to the top dead centers. Also, when discharging liquid, the diaphragms 131 and 231 of the diaphragm pumps 130 and 230 do not have to be displaced to the bottom dead centers.

In the above embodiments, the liquid supply flow paths 110 and 210 may be connected at the upstream sides thereof to different liquid supply sources 31, respectively.

In the above embodiments, the medium ST is not limited to paper, and may be cloth, plastic film, or the like.

In the above embodiments, the diaphragm pumps 130 and 230 may be other types of reciprocating pumps such as piston pumps and plunger pumps.

In the above embodiments, the liquid ejecting apparatus may be a liquid ejecting apparatus that ejects or discharges liquid other than ink. The liquid ejected in the form of very small amounts of droplets from the liquid ejecting apparatus may be in a granular shape, a teardrop shape or a tapered threadlike shape. The liquid herein may be any material that can be ejected from the liquid ejecting apparatus. For example, the liquid may be any material in the liquid phase, and may include liquid materials of high viscosity or low viscosity, sols, aqueous gels and other liquid materials including inorganic solvents, organic solvents, solutions, liquid resins and liquid metals (metal melts). The liquid is not limited to liquid as a state of the material, but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks. A specific example of the liquid ejecting apparatus may be a liquid ejecting apparatus that ejects liquid containing a material such as an electrode material or a colorant dispersed or dissolved therein, the electrode material or the colorant being used for manufacturing, for example, a liquid crystal display, an EL (electroluminescence) display, a surface light emitting display or a color filter. The liquid ejecting apparatus may be a liquid ejecting apparatus that ejects a living organic material to be used for manufacturing a biochip, a liquid ejecting apparatus used as a precision pipette that ejects liquid to be a sample, a cloth printing apparatus or a micro dispenser. The liquid ejecting apparatus may be a liquid ejecting apparatus for pinpoint ejection of lubricating oil on precision machines such as clocks and cameras, or a liquid ejecting apparatus that ejects a transparent resin solution of, for example, ultraviolet curable resin, onto a substrate to manufacture a hemispherical microlens (optical lens) used for optical communication elements and the like. The liquid ejecting apparatus may be a liquid ejecting apparatus that ejects an acidic or alkaline etching solution to etch a substrate or the like.

The entire disclosure of Japanese Patent Application No. 2017-033598, filed Feb. 24, 2017 is expressly incorporated by reference herein.

What is claimed is:

1. A liquid ejecting apparatus comprising:

a liquid ejecting unit;

a plurality of liquid supply flow paths that have upstream sides connected to a liquid supply source and downstream sides merged and connected to a common flow path extending from the liquid ejecting unit, and that supply the liquid from a liquid supply source side toward the liquid ejecting unit; and a plurality of pumps that are provided in the respective liquid supply flow paths, each of the pumps pressure-feeding the liquid from the liquid supply source side toward the liquid ejecting unit by repeating a sucking state in which the liquid is sucked into a pump chamber thereof and a discharging state in which the liquid is discharged from the pump chamber;

wherein the plurality of pumps are configured such that when one of the pumps is in the discharging state and a storage amount of the liquid stored in the pump chamber of the one pump becomes equal to a threshold, a first pump operation of placing another of the pumps in the discharging state is performed;

wherein a value obtained by adding an inflow of the liquid flowed into the pump chamber of the other pump to an ejection amount of the liquid ejected from the liquid ejecting unit is defined as a discharge amount of the liquid discharged from the pump chamber of the one pump during a period of the discharging state; and wherein the storage amount of the liquid stored in the pump chamber of the one pump is calculated based on the discharge amount of the liquid.

2. The liquid ejecting apparatus according to claim 1, wherein the first pump operation is performed during an ejection operation of ejecting the liquid from the liquid ejecting unit.

3. The liquid ejecting apparatus according to claim 1, wherein before performing an ejection operation of ejecting the liquid from the liquid ejecting unit, if the storage amount of the liquid stored in the pump chamber of the one pump is equal to or less than the threshold, the first pump operation is performed.

4. The liquid ejecting apparatus according to claim 1, wherein an inflow of the liquid flowed from the pump chamber of the one pump in the discharging state into the pump chamber of the other pump in the sucking state is calculated by multiplying a predetermined set value by elapsed time during which the one pump is in the discharging state and the other pump is in the sucking state.

5. The liquid ejecting apparatus according to claim 1, wherein each of the pumps includes a first one-way valve that is located on the liquid supply source side with respect to the pump chamber, and that allows passage of the liquid from the liquid supply source side toward the pump chamber, a second one-way valve that is located on the liquid ejecting unit side with respect to the pump chamber, and that allows passage of the liquid from a pump chamber side toward the liquid ejecting unit, a displacement unit that forms a part of a wall surface of the pump chamber, and that is displaceable in a direction to change a volume of the pump chamber, a displacement mechanism that displaces the displacement unit in a direction of increasing the volume of the pump chamber, and a biasing member that biases the displacement unit in a direction of reducing the volume of the pump chamber, each of the pumps being configured to increase and reduce the volume of the pump chamber to alternately repeat the sucking state and the discharging state.

6. The liquid ejecting apparatus according to claim 5, wherein the displacement mechanism is a decompression pump that displaces the displacement unit in the direction of increasing the volume of the pump chamber by decompressing a space adjacent to the displacement unit; and wherein before performing an ejection operation of ejecting the liquid from the liquid ejecting unit, if elapsed time during which the other pump is in the sucking state is greater than a preset time, a second pump operation of causing the one pump and the other pump to suck the liquid is performed.

7. The liquid ejecting apparatus according to claim 1, wherein an on-off valve is provided that switches a restricted state in which the liquid is restricted from flowing through the common flow path to a communicating state in which the liquid is allowed to flow when an amount of liquid in a liquid chamber provided in the common flow path decreases.

8. A liquid supply method for a liquid ejecting apparatus including a plurality of liquid supply flow paths that supply liquid from a liquid supply source side toward a liquid ejecting unit that ejects the liquid, and a plurality of pumps that are provided in the respective liquid supply flow paths, each of the pumps pressure-feeding the liquid from the liquid supply source side toward the liquid ejecting unit by repeating a sucking state in which the liquid is sucked into a pump chamber thereof and a discharging state in which the liquid is discharged from the pump chamber, the liquid supply method comprising:

calculating a storage amount of the liquid stored in the pump chamber of one of the pumps that is in the discharging state based on a discharge amount of the liquid discharged from the pump chamber during a period of the discharging state, the discharge amount of the liquid being a value obtained by adding an inflow of the liquid flowed into the pump chamber of another of the pumps to an ejection amount of the liquid ejected from the liquid ejecting unit; and when the calculated storage amount of the liquid becomes equal to a threshold, performing a first pump operation of placing the other pump in the discharging state.

* * * * *